US010745168B2

(12) United States Patent
Dwork

(10) Patent No.: US 10,745,168 B2
(45) Date of Patent: Aug. 18, 2020

(54) FOOD CONTAINER WITH ADJUSTABLE COMPARTMENTS

(71) Applicant: Michael D. Dwork, New York, NY (US)

(72) Inventor: Michael D. Dwork, New York, NY (US)

( * ) Notice: Subject to any disclaimer, the term of this patent is extended or adjusted under 35 U.S.C. 154(b) by 0 days.

(21) Appl. No.: 16/157,164

(22) Filed: Oct. 11, 2018

(65) Prior Publication Data

US 2019/0112094 A1 Apr. 18, 2019

Related U.S. Application Data

(60) Provisional application No. 62/571,434, filed on Oct. 12, 2017.

(51) Int. Cl.

| | |
|---|---|
| ***B65D 5/49*** | (2006.01) |
| ***B65D 6/22*** | (2006.01) |
| ***B65D 5/02*** | (2006.01) |
| ***B65D 5/36*** | (2006.01) |
| ***B65D 25/54*** | (2006.01) |
| ***B65D 51/24*** | (2006.01) |
| ***B65D 25/06*** | (2006.01) |
| ***B65D 5/66*** | (2006.01) |

(52) U.S. Cl.

CPC ..... *B65D 5/48038* (2013.01); *B65D 5/0254* (2013.01); *B65D 5/3607* (2013.01); *B65D 5/3642* (2013.01); *B65D 5/6685* (2013.01); *B65D 9/18* (2013.01); *B65D 25/06* (2013.01); *B65D 25/54* (2013.01); *B65D 51/24* (2013.01)

(58) Field of Classification Search

CPC ..... B65D 5/48038; B65D 5/0254; B65D 5/3607; B65D 5/3642; B65D 5/6685; B65D 9/18; B65D 25/06; B65D 25/54; B65D 51/24; B65D 25/04; B65D 5/36; B65D 5/48024; B65D 5/48

USPC ..... 229/120.36, 120.26, 120.27, 120.28, 229/120.33, 120.34, 125.08, 126; 206/192, 196; 220/510

See application file for complete search history.

(56) References Cited

U.S. PATENT DOCUMENTS

| | | | | |
|---|---|---|---|---|
| 1,962,492 | A * | 6/1934 | Fallert | B65D 5/321 229/122.34 |
| 1,995,482 | A * | 3/1935 | Piautz | B65D 5/48038 217/30 |
| 2,167,741 | A * | 8/1939 | Boh | B65D 5/6635 229/122.24 |
| 2,749,014 | A * | 6/1956 | Russell | B65D 5/22 229/120.03 |
| 3,425,616 | A * | 2/1969 | Adams, Jr. | B65D 5/3607 229/120.05 |
| 4,187,975 | A | 2/1980 | Shepherd | |
| 5,456,352 | A | 10/1995 | McQueeny | |

(Continued)

*Primary Examiner* — Christopher R Demeree

(74) *Attorney, Agent, or Firm* — Merchant & Gould P.C.

(57) ABSTRACT

A food container includes a bottom panel and sidewalls pivotally connected to the bottom panel. A lid is pivotally connected to at least one sidewall to open and close the food container. A divider panel having at least one slot is inserted into any one of a plurality of slots in a spacer panel to create an adjustable compartment arrangement inside an internal cavity of the food container. The divider panel includes a groove that provides a recess between the divider panel and a sidewall of the food container that can accommodate a lip of the lid.

21 Claims, 29 Drawing Sheets

(56) References Cited

U.S. PATENT DOCUMENTS

| | | | | |
|---|---|---|---|---|
| 7,543,734 | B2 * | 6/2009 | Wang | B65D 5/48004 229/120.04 |
| 9,096,349 | B2 | 8/2015 | Youell et al. | |
| 2009/0314663 | A1 * | 12/2009 | Holley, Jr. | B65D 5/48038 206/139 |
| 2014/0097235 | A1 * | 4/2014 | Adams | B65D 5/42 229/103 |
| 2014/0263353 | A1 * | 9/2014 | Bell | B65D 25/06 220/531 |

* cited by examiner

FOOD CONTAINER WITH ADJUSTABLE COMPARTMENTS

CROSS-REFERENCE TO RELATED APPLICATIONS

This application claims priority to U.S. Provisional Patent Application 62/571,434 filed Oct. 12, 2017, the disclosure of which is incorporated herein by reference in its entirety.

BACKGROUND

Disposable containers are often used to store food products to preserve the freshness of food and to protect food from outside elements. For example, food can be placed in disposable food containers for transport from a restaurant for delivery to a customer. Also, food can be placed in disposable containers for display in a store or restaurant, so that the food can be purchased by a customer directly at the location of the store or restaurant.

Often it is desirable to place a variety of different food items within a single container. To avoid one food item from mixing with another, different compartments can be arranged inside the container to organize and separate food items within the container.

It is well documented that packaging waste creates a rubbish problem that pollutes the environment. Businesses, particularly foodservice companies such as restaurants, schools and hospital cafeterias, catering operations and the like, are now starting to choose environmentally friendly packaging, and the general public is becoming more and more influenced by this choice. It is therefore desirable for containers to be environmentally sustainable and eco-friendly.

Food containers must also be able to withstand buckling and deforming from the weight of the food items, while being easy to store, assemble and use.

Therefore, improvements are needed for eco-friendly food containers that have multiple customized configurations, easy to store, assemble and use, and that are also structurally durable.

SUMMARY

The present disclosure relates generally to a food container. In one possible configuration and by non-limiting example, the food container includes an adjustable compartment arrangement for holding and organizing different food items.

In one aspect, a food container comprises a body portion including: a bottom panel; a plurality of sidewalls, each sidewall pivotally connected to the bottom panel; a lid pivotally connected to at least one sidewall, the lid having a lip; and a spacer panel system inserted into the body portion. The spacer panel system includes: a spacer panel having a body with one or more slots; and at least one divider panel having a body with a slot and a groove located on at least one end of the body. The slot of the at least one divider panel is insertable into any one of the slots of the spacer panel, and the groove of the at least one divider panel provides a recess between the spacer panel system and a sidewall of the body portion.

In another aspect, a food container food container comprises: a body having a bottom panel and side panels extending from the bottom panel at an inclined angle; and a first diagonal panel having a first slot and lateral sides, each lateral side accommodated in a first pair of opposing corners in the body.

In yet another aspect, a method of assembling a food container comprises: gathering a body portion in a folded position; pivoting a lid to transition from the folded position into a flipped position; pivoting a first pair of opposing sidewalls from a horizontal position to a vertical position to transition from the flipped position into a partially upright position; pivoting a second pair of opposing sidewalls from the horizontal position to the vertical position to transition from the partially upright position to the upright position; generating a spacer panel system; and inserting the space panel system into the body portion to generate a compartment arrangement inside an internal cavity of the body portion.

In another aspect, a method of assembling a food container comprises: gathering a body having a bottom panel and a plurality of side panels; gathering a first diagonal panel; inserting lateral sides of the first diagonal panel into the opposing corners of the body; gathering a second diagonal panel; and coupling a slot of the second diagonal panel to the first diagonal panel.

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts upon which the examples disclosed herein are based.

BRIEF DESCRIPTION OF THE DRAWINGS

The following drawings are illustrative of particular embodiments of the present disclosure and therefore do not limit the scope of the present disclosure. The drawings are not necessarily to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
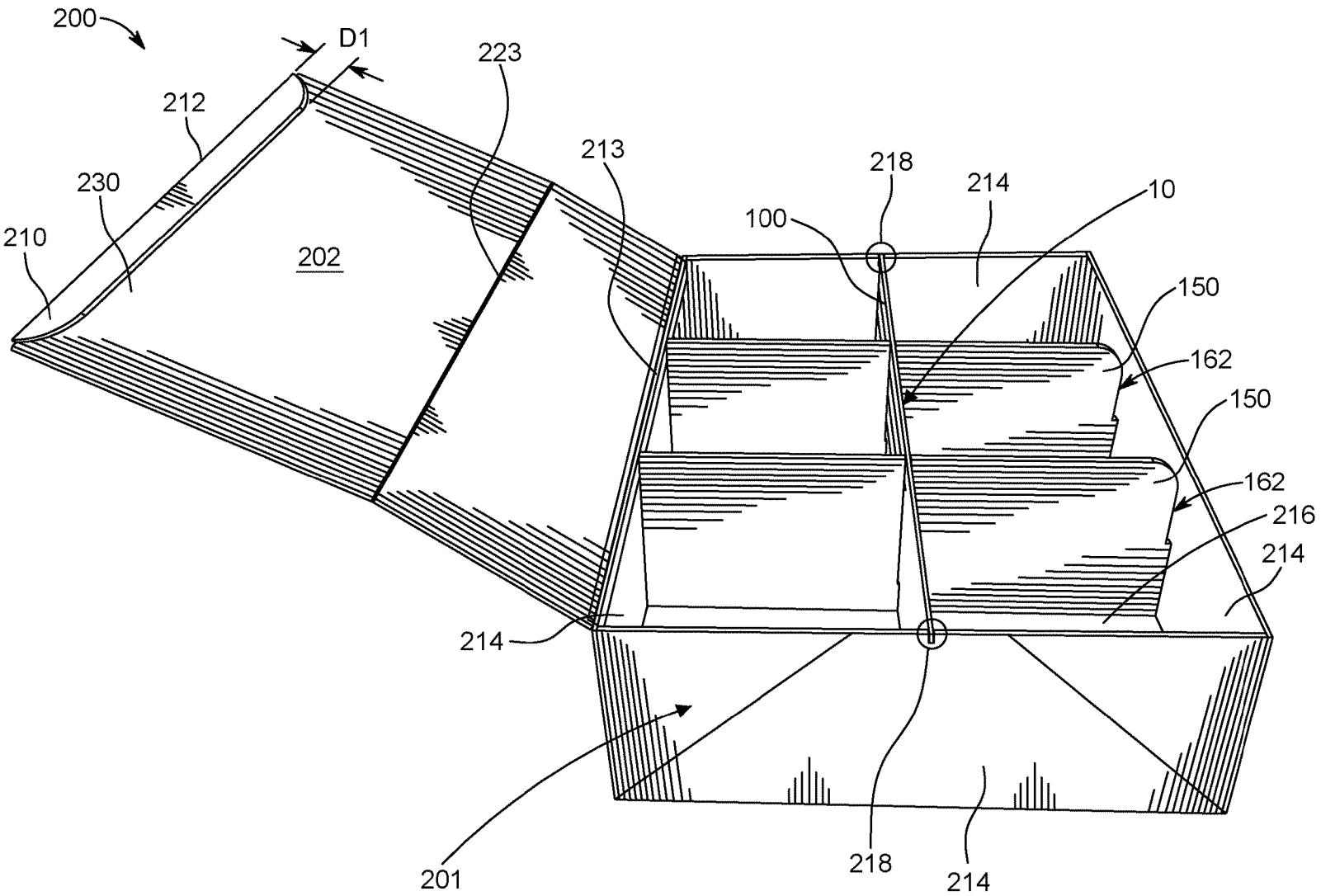
FIG. 1 is an isometric view of a food container in an open configuration.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is an isometric view of a food container 200 in an open configuration. As shown in FIG. 1, the food container 200 includes a body portion 201 having a plurality of sidewalls 214, a bottom panel 216, and a lid 202. The food container 200 further includes a spacer panel system 10 having a spacer panel 100 and at least one divider panel 150 inserted in the body portion 201.

Each sidewall 214 is a flat panel attached to the bottom panel 216. The sidewalls 214 are arranged around the bottom panel 216 such that the body portion 201 of the food container 200 has a substantially rectangular shape. As used throughout this disclosure, the term rectangular includes a square. It is contemplated that the body portion 201 can have alternative shapes including various quadrilateral, parallelogram, triangular, circular, oval, and the like.

A lid 202 is pivotally connected to at least one sidewall 214 along a first hinge 213. As used throughout this disclosure, the term hinge includes crease, fold, bend, flexure, and the like. The lid 202 includes a lip 210 and a cover portion 230. The lip 210 is connected to the cover portion 230 along a second hinge 212. The lip 210 has a first depth D1. Optionally, the lid 202 includes a third hinge 223 between the first hinge 213 and the second hinge 212. The third hinge 223 allows the lid 202 to be folded underneath the bottom panel 216, as described in U.S. Pat. No. 9,505,536, which is incorporated herein by reference in its entirety.

The body portion 201 including the sidewalls 214, bottom panel 216, and lid 202 are preferably made from a sustainable and eco-friendly material that is structurally durable so that the food container 200 does not buckle or deform from the weight of food, and is oil and water resistant. In some examples, the sidewalls 214, bottom panel 216, and lid 202 are made from a re-usable wood material. In certain examples, the re-usable wood material is a wax coated balsa wood. In alternative examples, the sidewalls 214, bottom panel 216, and lid 202 are made from a single die cut piece of corrugated palm leaf, cardboard, paper board, or fiber board.

Figure 2:
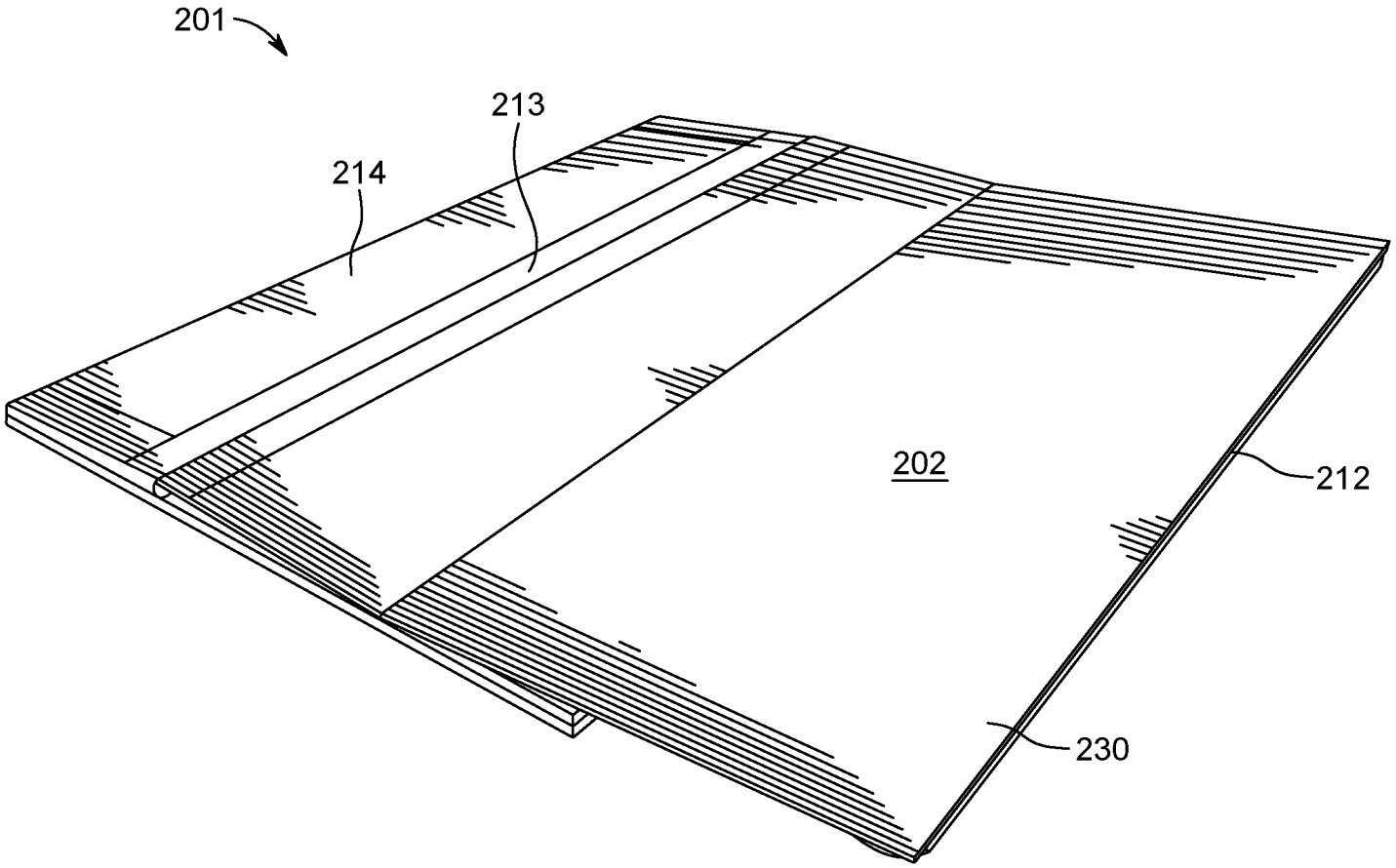
FIG. 2 is an isometric view of a body portion of the food container in a folded position.

FIG. 2 is an isometric view of the body portion 201 in a folded position. As shown in FIG. 2, the body portion 201 is substantially flat in the folded position. The body portion 201 is stackable in the folded position such that a large quantity can be stored within a container or storage area when in the folded position.

Figure 3:
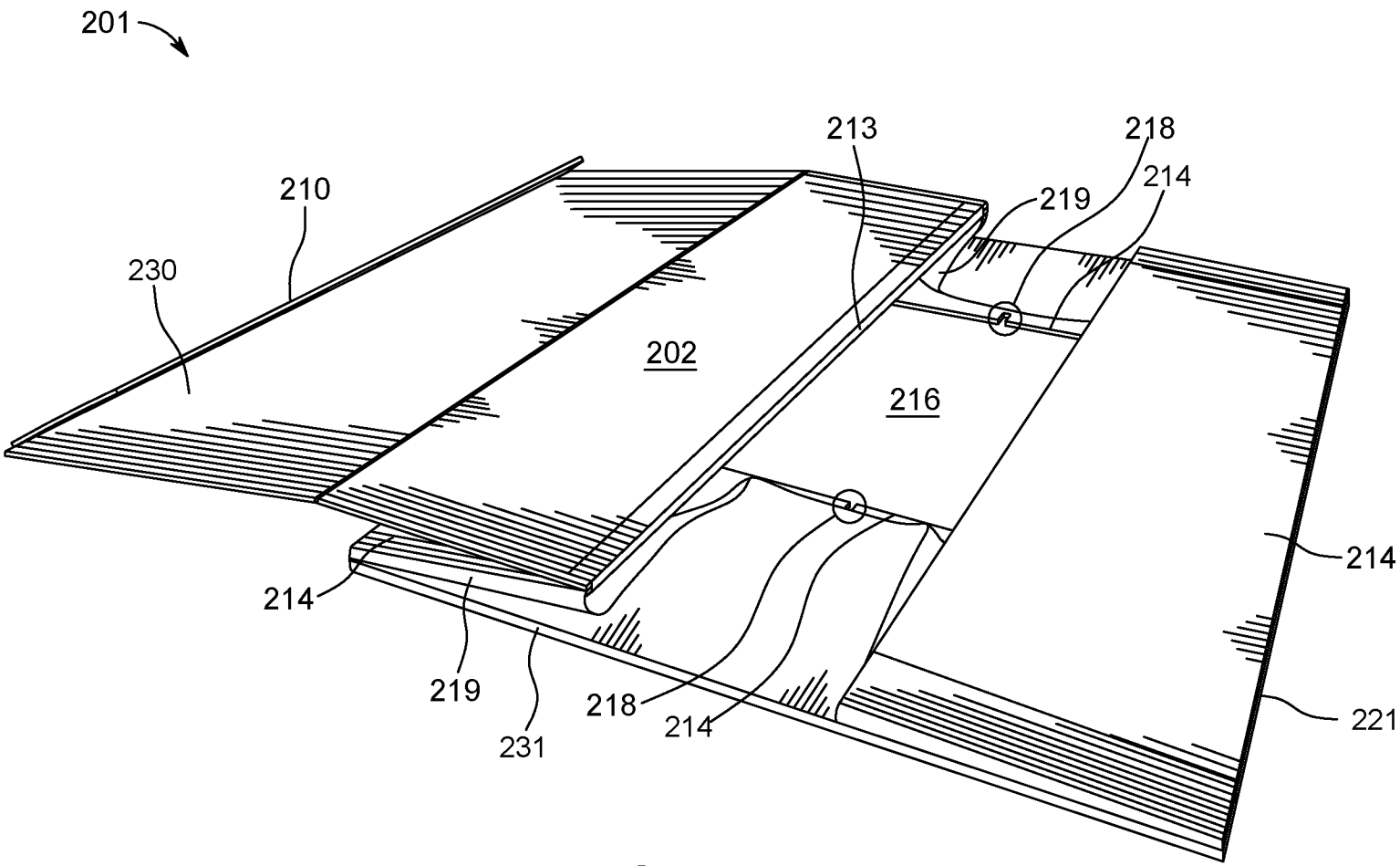
FIG. 3 is an isometric view of the body portion in a flipped position.

Aspects of assembling the body portion 201 from the folded position to a fully operational upright position, and various features of the food container 200 are now described in connection with FIGS. 2-9. FIG. 3 is an isometric view of the body portion 201 in a flipped position. To assemble the body portion 201, it is transitioned from the folded position into the flipped position by pivoting the lid 202 about the first hinge 213. As shown in FIG. 3, the sidewalls 214 in the flipped position are arranged in a horizontal position. In the horizontal position, the sidewalls 214 are substantially parallel to the bottom panel 216.

Figure 4:
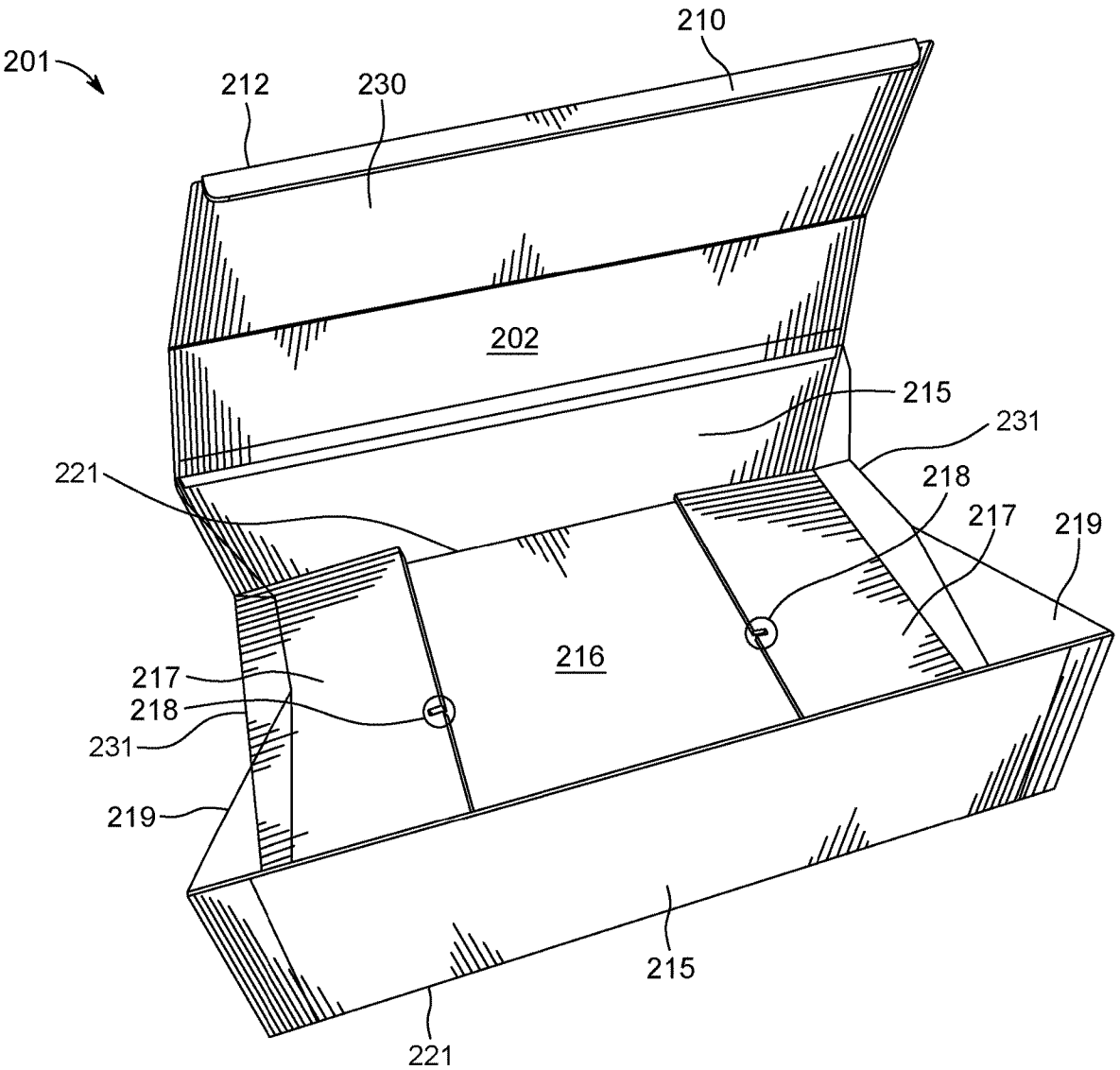
FIG. 4 is an isometric view of the body portion in a partially upright position.

FIG. 4 is an isometric view of the body portion 201 in a partially upright position. As shown in FIG. 4, a first pair of opposing sidewalls 215 are pivoted about hinges 221 from the horizontal position to a vertical position. In the vertical position, the sidewalls 214 are substantially perpendicular to the bottom panel 216. In the partially upright position, a second pair of opposing sidewalls 217 remains in the horizontal position.

FIGS. 5-9 are isometric, left side, right side, front, and rear views, respectively, of the body portion 201 in an upright position. The body portion 201 can be transitioned from the flipped position (see FIG. 3) into the upright position (see FIG. 5) by pivoting about hinges 221 the first pair of opposing sidewalls 215 from the horizontal position to the vertical position, and then pivoting about hinges 231 the second pair of opposing sidewalls 217 from the horizontal position to the vertical position. Thus, in the upright position, the first pair of opposing sidewalls 215 are arranged in the vertical position, and the second pair of opposing sidewalls 217 are also arranged in the vertical position.

Alternatively, the body portion 201 can be transitioned from the upright position into the flipped position by pivoting about the hinges 231 the second pair of opposing sidewalls 217 from the vertical position to the horizontal position, and then pivoting about hinges 221 the first pair of opposing sidewalls 215 from the vertical position to the horizontal position. Thereafter, the lid 202 can be pivoted about the first hinge 213 so that the body portion 201 can be folded from the flipped position into the folded position.

Figure 5:
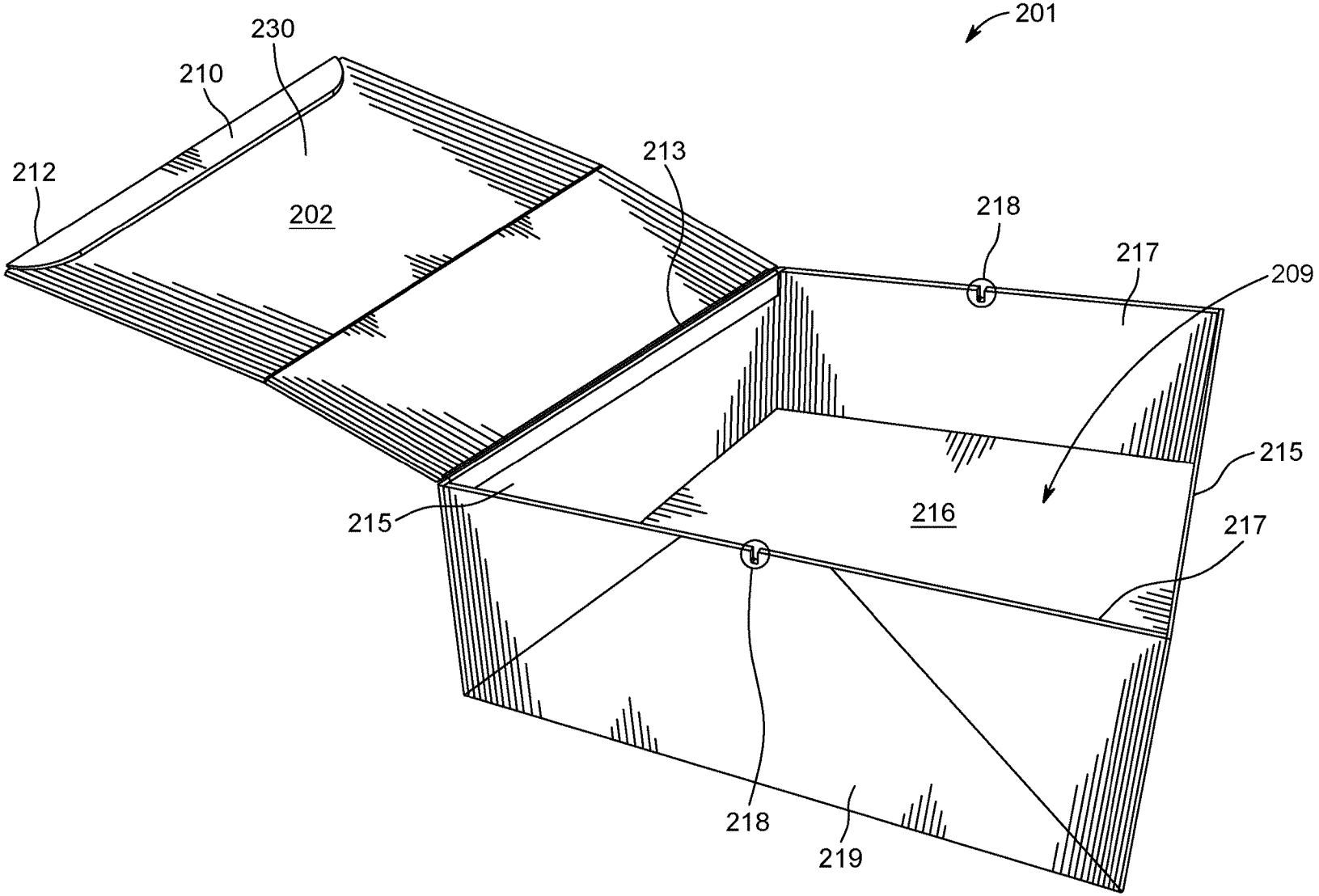
FIG. 5 is an isometric view of the body portion in an upright position.

As shown in FIGS. 3, 4 and 5, the body portion 201 includes foils 219 that each extend adjacent to a sidewall in the second pair of opposing sidewalls 217. The foils 219 operate to guide the transition of the body portion 201 from the flipped position to the upright position by guiding the first pair of opposing sidewalls 215 to pivot about the hinges 221 with respect to the bottom panel 216, and thereafter can help guide the second pair of opposing sidewalls 217 to pivot about the hinges 231 with respect to the bottom panel 216. Thus, the foils 219 can help to arrange the sidewalls 214 around the bottom panel 216 by guiding each pair of opposing sidewalls from the horizontal position to the vertical position.

The foils 219 also operate to lock the second pair of opposing sidewalls 217 in position, which in conjunction with adjacent support from the first pair of opposing sidewalls 215, prevent the second pair of opposing sidewalls 217 from pivoting more than 90 degrees with respect to the bottom panel 216 such that they are kept orthogonal to the bottom panel 216. This maintains the body portion 201 in the upright position. In some examples, the foils 219 are made from rice paper, wax paper, mulberry paper, and other paper-like materials.

As shown in FIGS. 5-9, when in the upright position, the first pair of opposing sidewalls 215 are substantially parallel with one another. Similarly, the second pair of opposing sidewalls 217 are substantially parallel with one another. Accordingly, the body portion 201 has a substantially rectangular shape that defines an internal cavity 209. The spacer panel system 10 (described in more detail below) can be inserted into the internal cavity 209 for organizing different types food items within the internal cavity 209 of the body portion 201.

Figure 10:
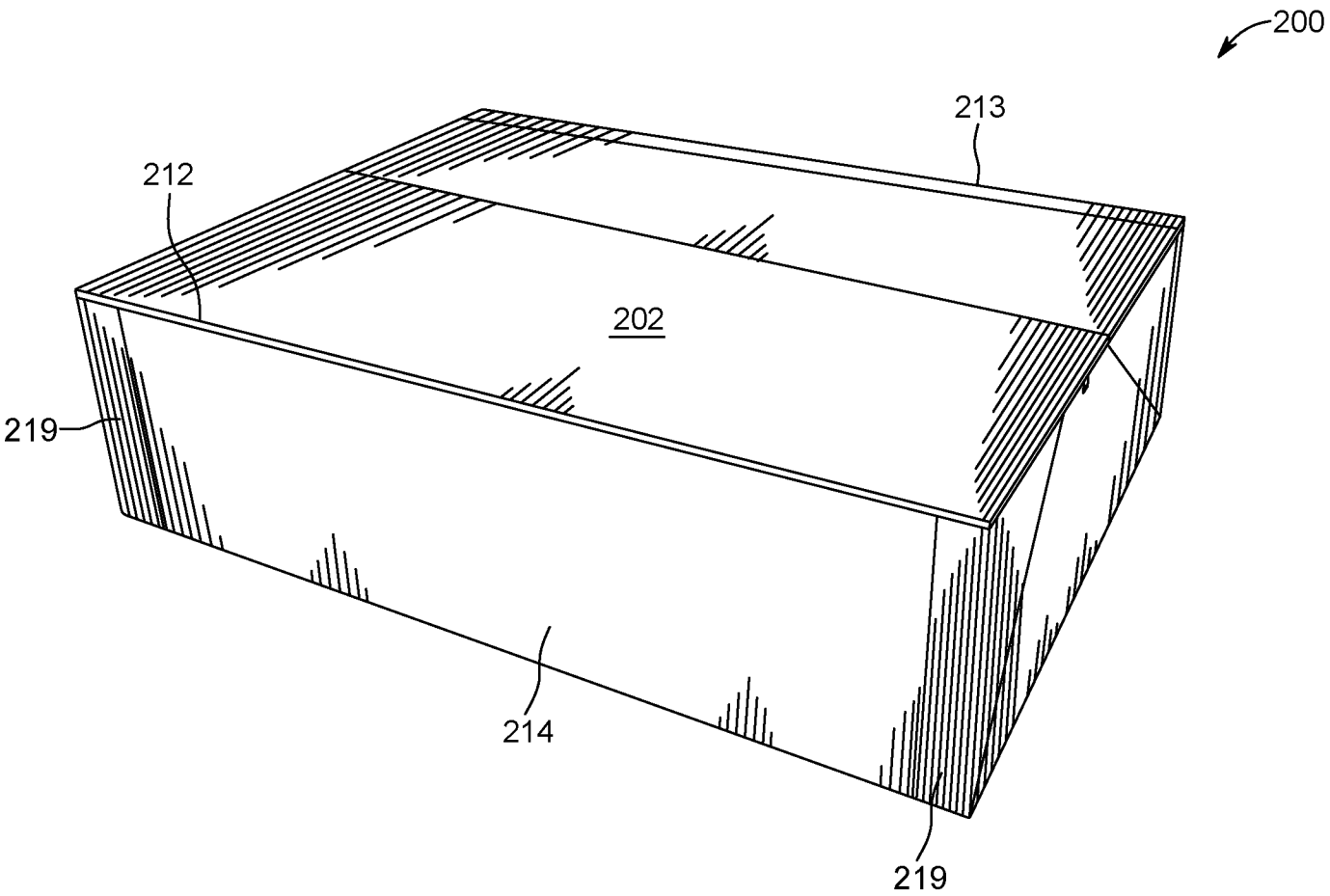
FIG. 10 is an isometric view of the food container in a closed configuration.

FIG. 10 is an isometric view of the food container 200 in a closed configuration. As shown in FIG. 10, the lid 202 is pivoted about the first hinge 213 in the closed configuration such that the lip 210 is inserted inside the internal cavity 209 and the cover portion 230 covers the internal cavity 209 to protect and maintain the temperature of food inside the food container 200. As described above, the lip 210 can pivot with respect to the cover portion 230 along the second hinge 212 allowing the lip 210 to be inserted inside the internal cavity 209. Accordingly, the internal cavity 209 is constructed to receive the lip 210.

Figure 11:
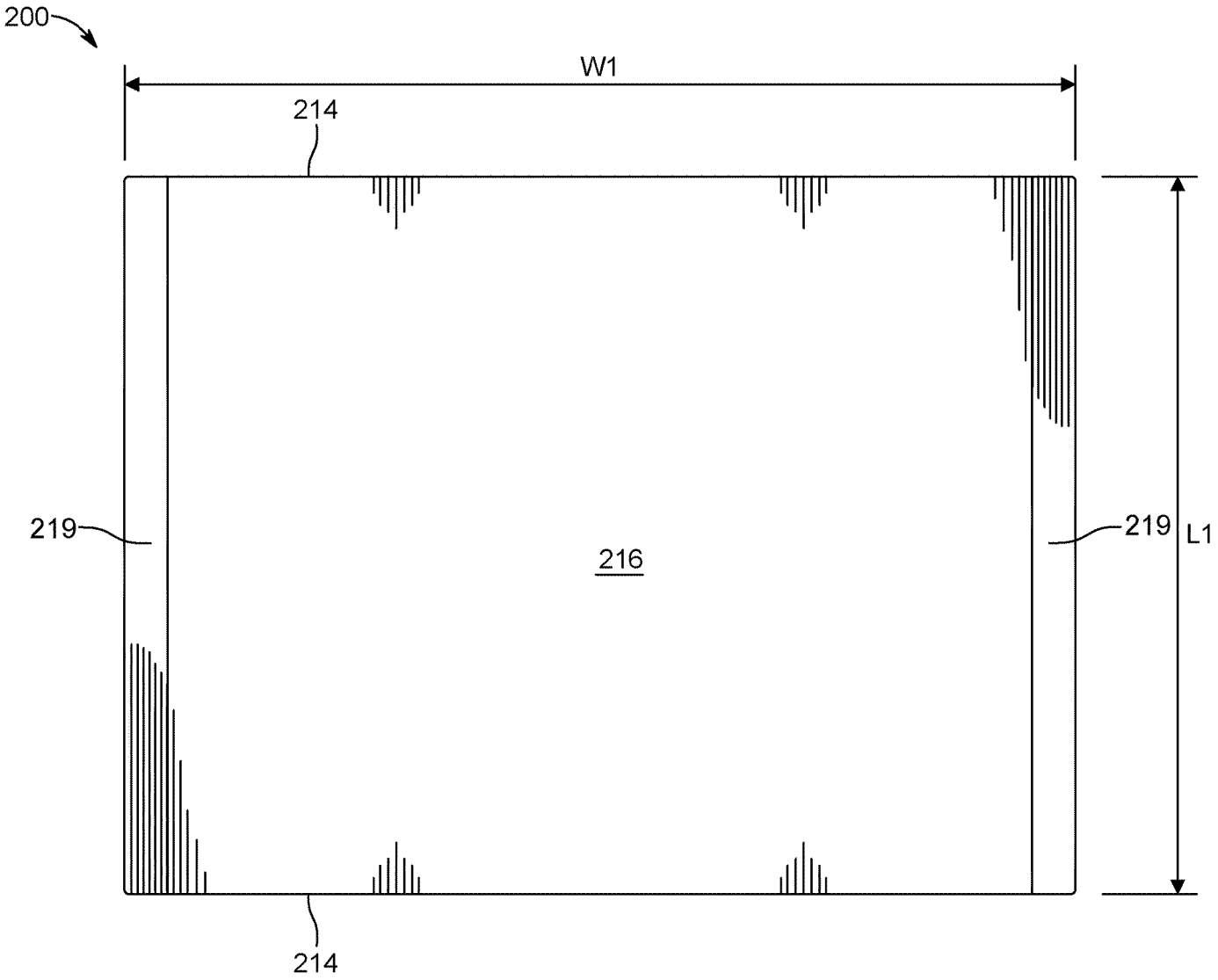
FIG. 11 is a bottom view of the food container in the closed configuration.

FIG. 11 is a bottom view of the food container 200 in the closed configuration. As shown in FIG. 11, the food container 200 has a length L1 and a width W1 giving the food container 200 a substantially rectangular or square shape. In some examples, the food container 200 is sized such that the length L1 and width W1 are 4×6 inches, 6×6 inches, 11×15 inches, and 18×24 inches, respectively. Other sizes and configurations are also possible.

Figure 6:
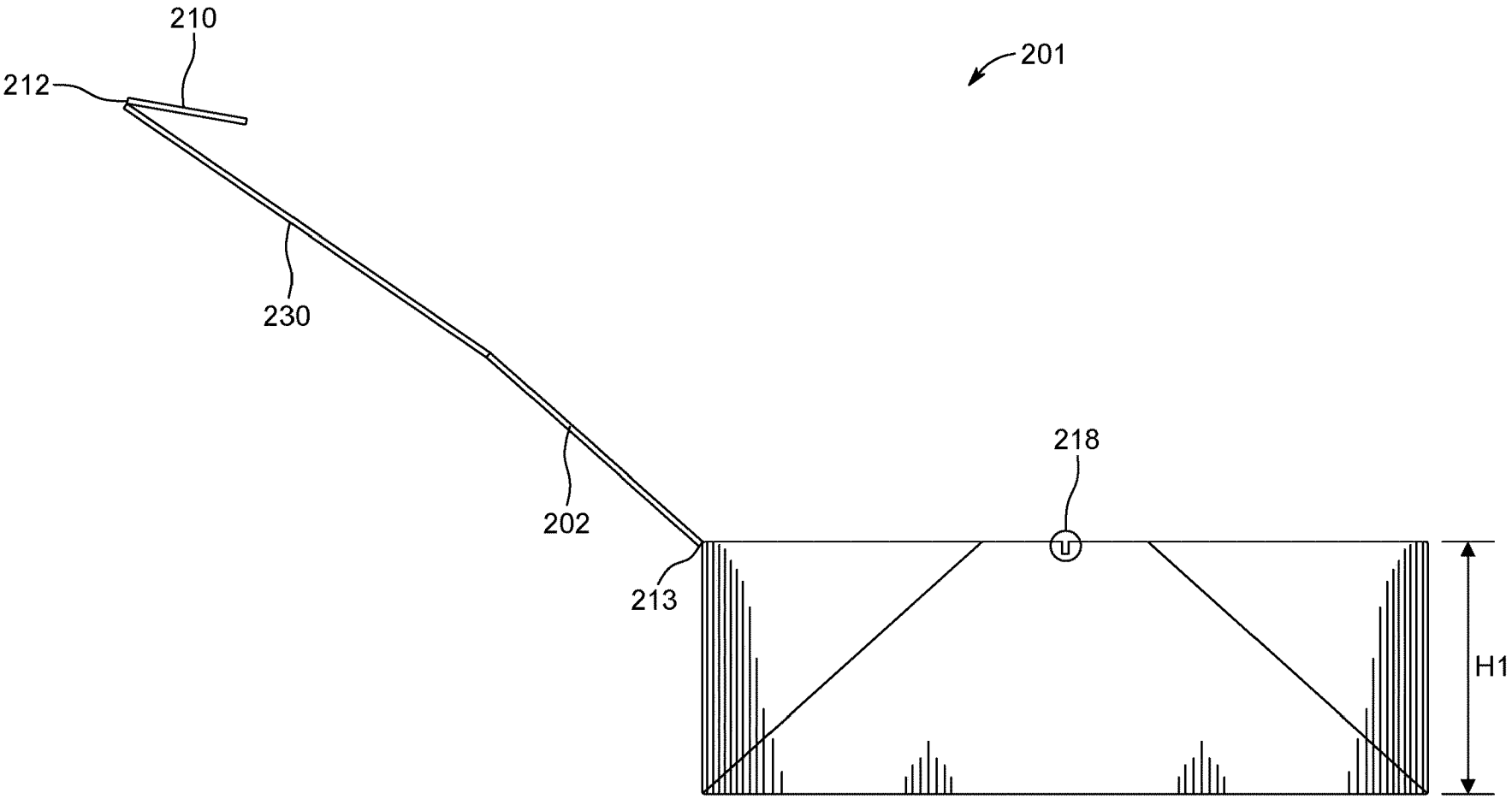
FIG. 6 is a left side view of the body portion in the upright position.
Figure 7:
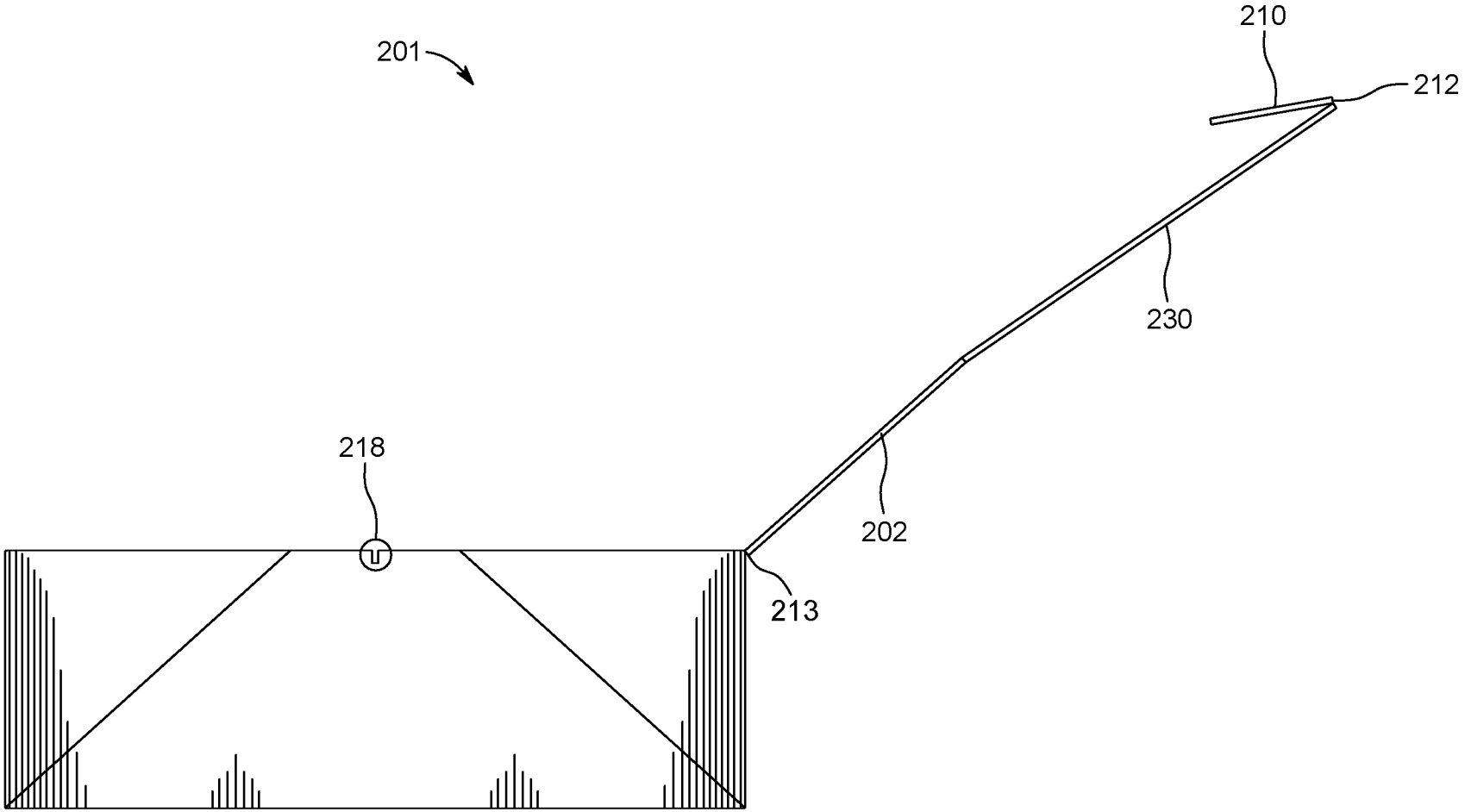
FIG. 7 is a right side view of the body portion in the upright position.
Figure 8:
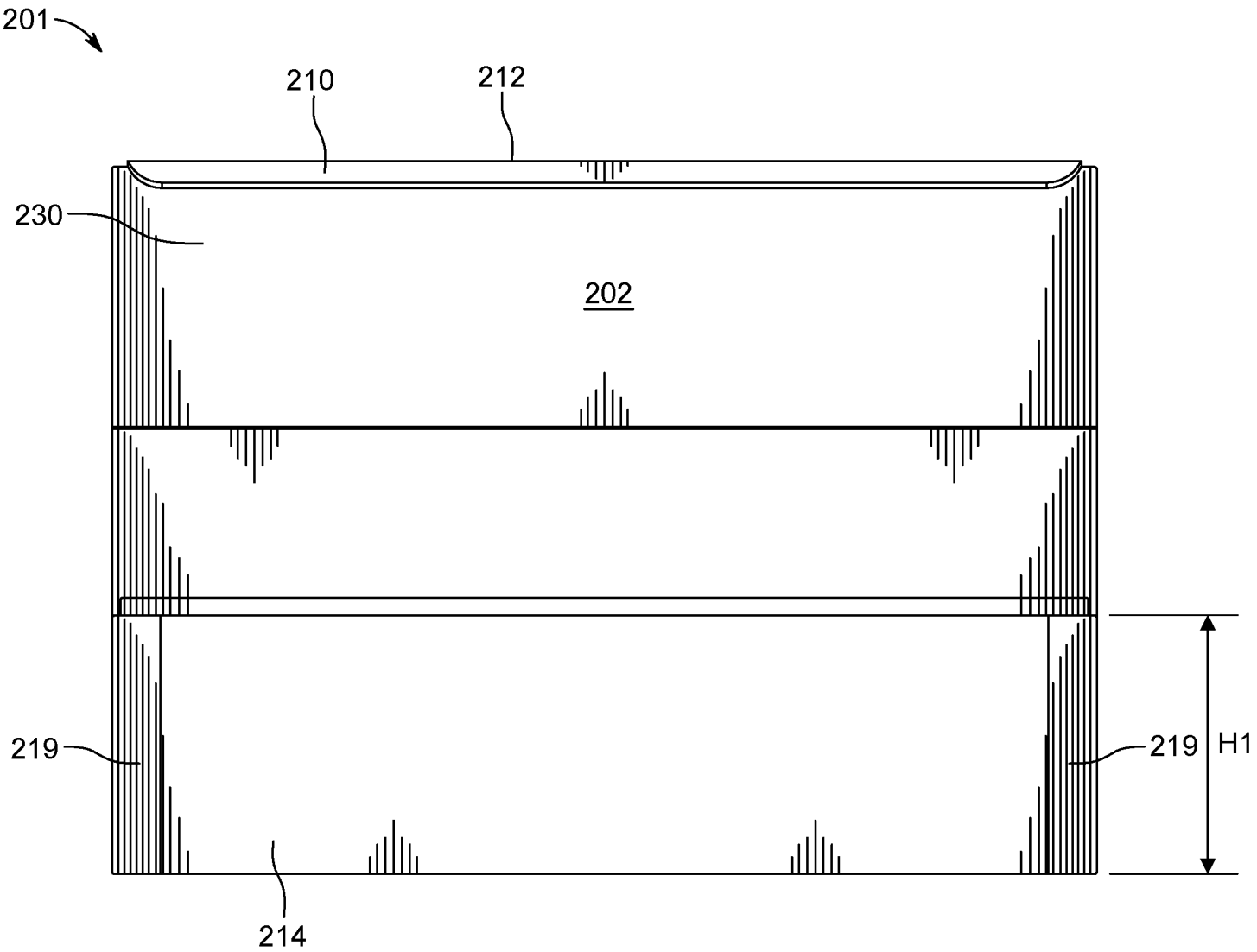
FIG. 8 is a front view of the body portion in the upright position.
Figure 9:
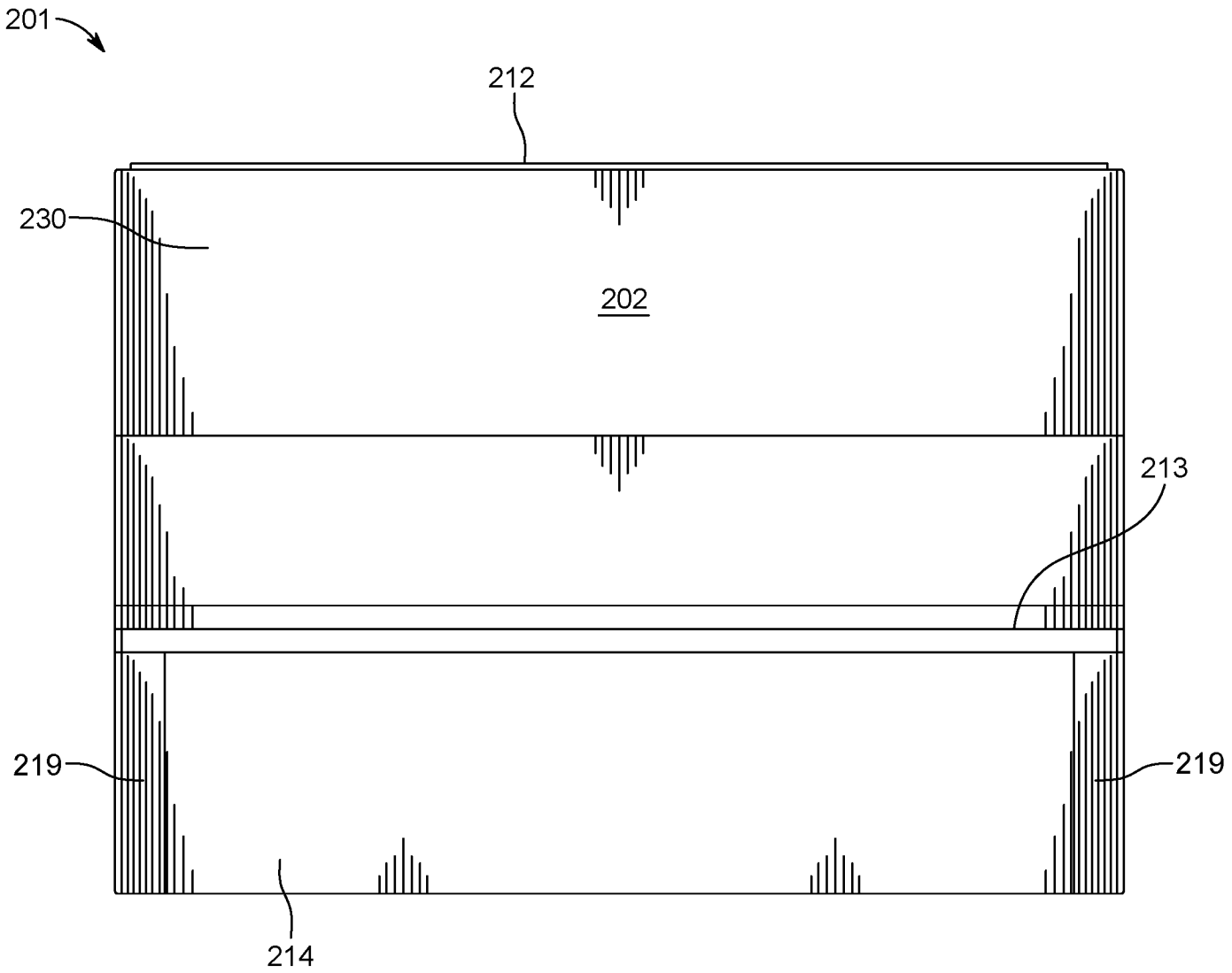
FIG. 9 a rear view of the body portion in the upright position.

As shown in FIGS. 6 and 8, each sidewall 214 has a height H1. In some examples, the height H1 is in a range from about 1 to about 6 inches. Given the exemplary dimensions for the width W1, the length L1, and the height H1, in some examples, the internal cavity 209 of the food container 200 has a volume of about 36 cubic inches to about 2600 cubic inches for holding and organizing food items within the food container 200.

Figure 12:
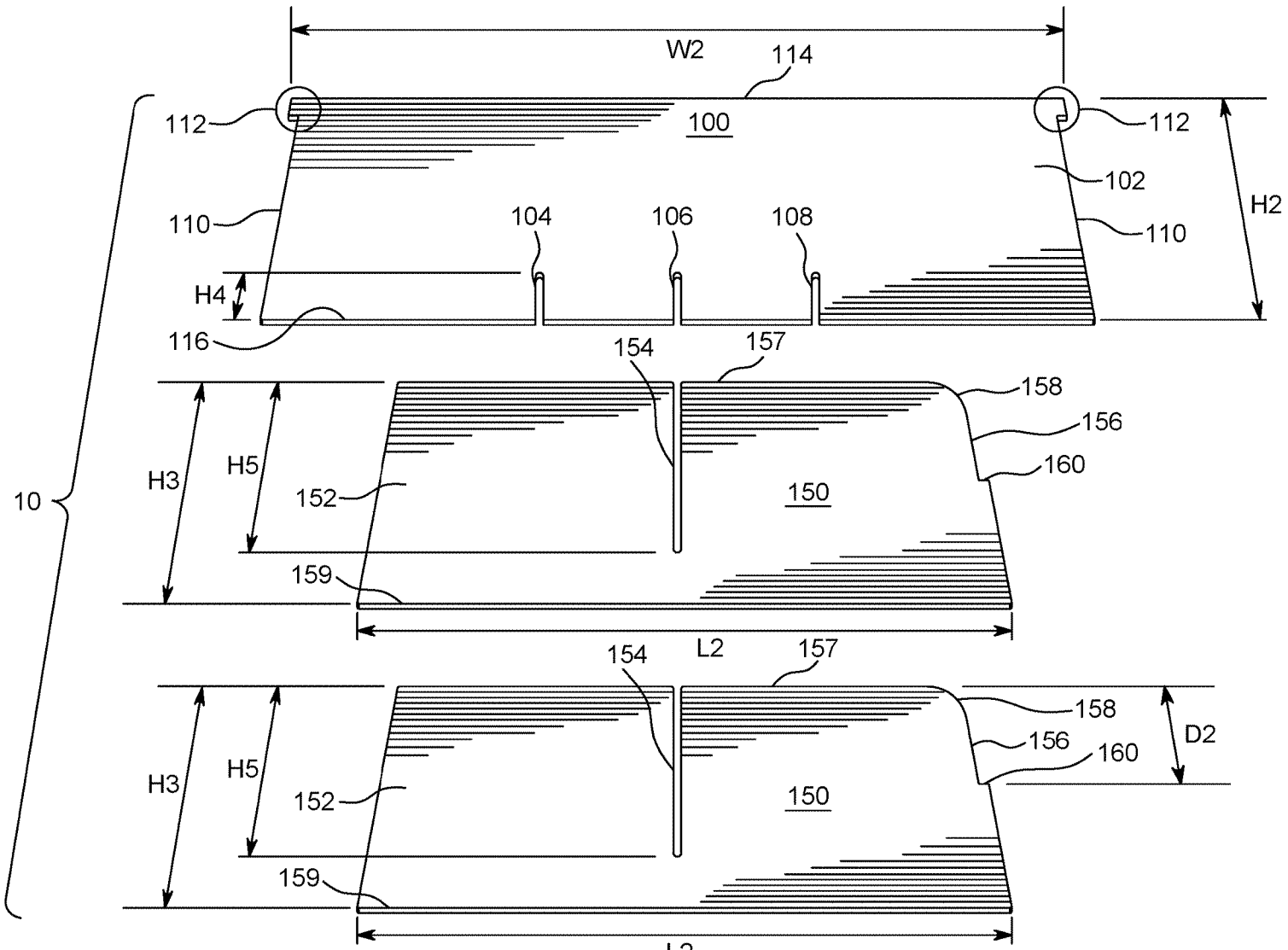
FIG. 12 is an isometric view of a spacer panel system in a disassembled state.
Figure 13:
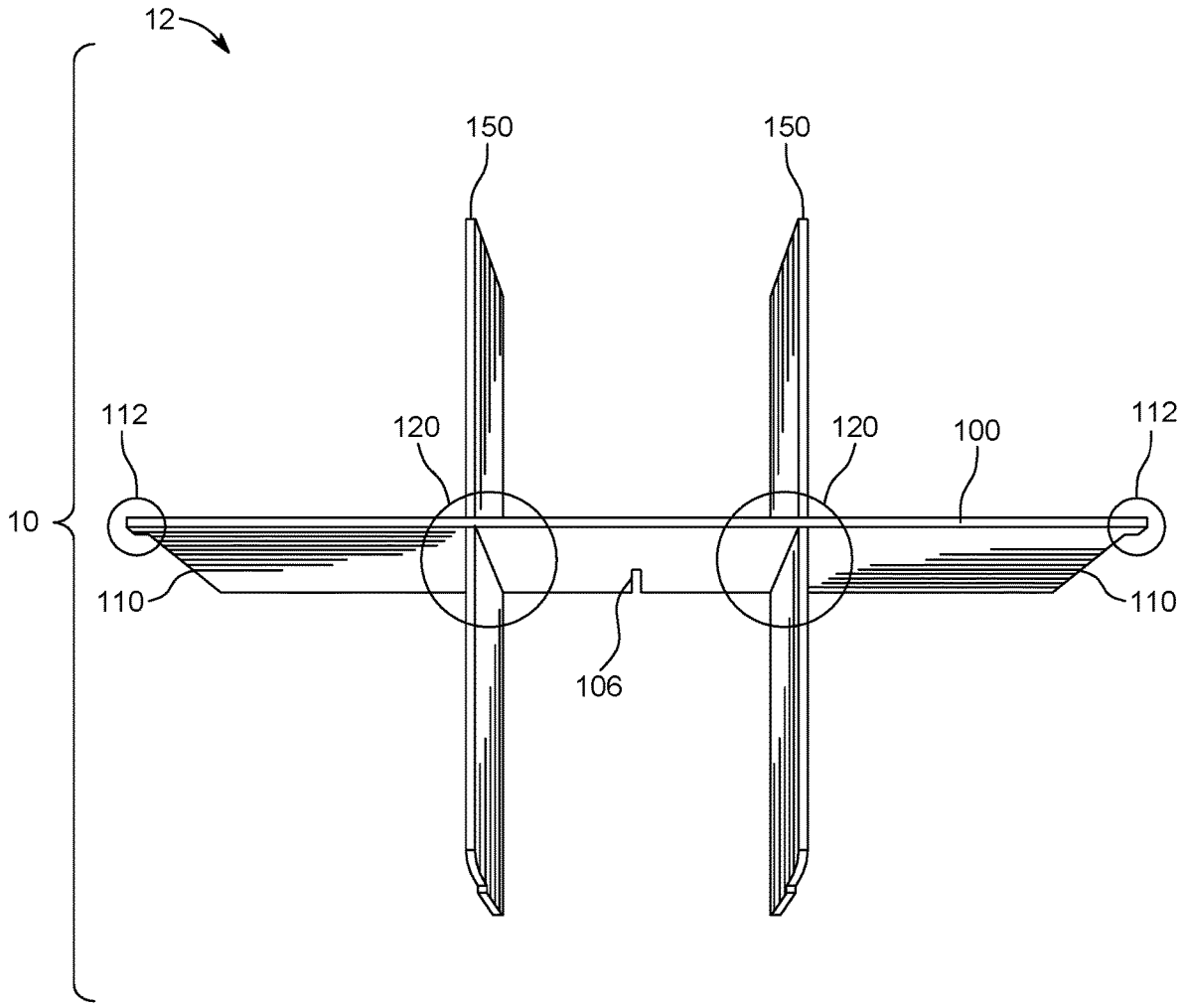
FIG. 13 is an isometric view of the spacer panel system in an assembled state.

FIGS. 12 and 13 are isometric views of the spacer panel system 10 in a disassembled state and an assembled state, respectively. As shown in FIGS. 12 and 13, the spacer panel system 10 includes the spacer panel 100. The spacer panel includes a body 102 having slots 104, 106, 108. The slots 104, 106, 108 are located on a second surface 116 of the spacer panel 100. The second surface 116 of the spacer panel 100 abuts the bottom panel 216 of the body portion 201 when the spacer panel system 10 is inserted inside the internal cavity 209. In the example depicted in FIGS. 12 and 13, the spacer panel 100 includes three slots. In alternative examples, the spacer panel 100 includes fewer than three slots or more than three slots.

As further shown in FIGS. 12 and 13, the spacer panel 100 includes a first surface 114, opposing ends 110, and a tab 112 on each opposing end 110. In the depicted example, the tabs 112 are located in the corners between the first surface 114 and the opposing ends 110. In other examples, the tabs 112 are located elsewhere on the opposing ends 110.

As shown in FIGS. 3-7, each sidewall in the second pair of opposing sidewalls 217 includes a notch 218. As shown in FIGS. 1 and 14-16, each tab 112 of the spacer panel 100 is insertable into a notch 218 to anchor and secure the spacer panel 100 (and the spacer panel system 10) inside the internal cavity 209 of the food container 200. The tabs 112 when inserted into the notches 218 also provide another significant advantage of further strengthening the structural rigidity of the food container 200 and the spacer panel system 10. For example, anchoring and securing the spacer panel 100 inside the internal cavity 209 can help to prevent the food container from buckling or deforming from weight and pressure.

In some examples where the body portion 201 and the spacer panel system 10 are made from corrugated palm leaf, cardboard, paper board, or fiber board, notch 218 can be a groove such as a simple channel groove configured to receive the spacer panel system 10.

As shown in FIGS. 12 and 13, the spacer panel system 10 further includes at least one divider panel 150 having a body 152, a slot 154, and a groove 156. The slot 154 is located on a first surface 157 of the body of the divider panel 150. A second surface 159 of the divider panel 150 abuts the bottom panel 216 of the food container 200 when the spacer panel system 10 is inserted inside the internal cavity 209 of the food container 200. The slot 154 can be inserted into any one of the slots 104, 106, 108 of the spacer panel 100 to create an intersection 120 between the at least one divider panel 150 and the spacer panel 100. The intersection 120 can temporarily attach the at least one divider panel 150 to the spacer panel 100 due to friction at the intersection 120 between the spacer panel 100 and the divider panel 150.

Various combinations of spacer panels 100 and divider panels 150 can be generated. Each combination of spacer panel 100 and divider panel 150 can provide a unique compartment arrangement. For example, FIG. 13 depicts a first compartment arrangement 12 where the spacer panel system 10 includes one spacer panel 100 and two divider panels 150 that are equally spaced apart. The first compartment arrangement 12 when inserted inside the internal cavity 209 of the body portion 201 can provide six compartments of equal size (see FIGS. 1 and 19).

Figure 14:
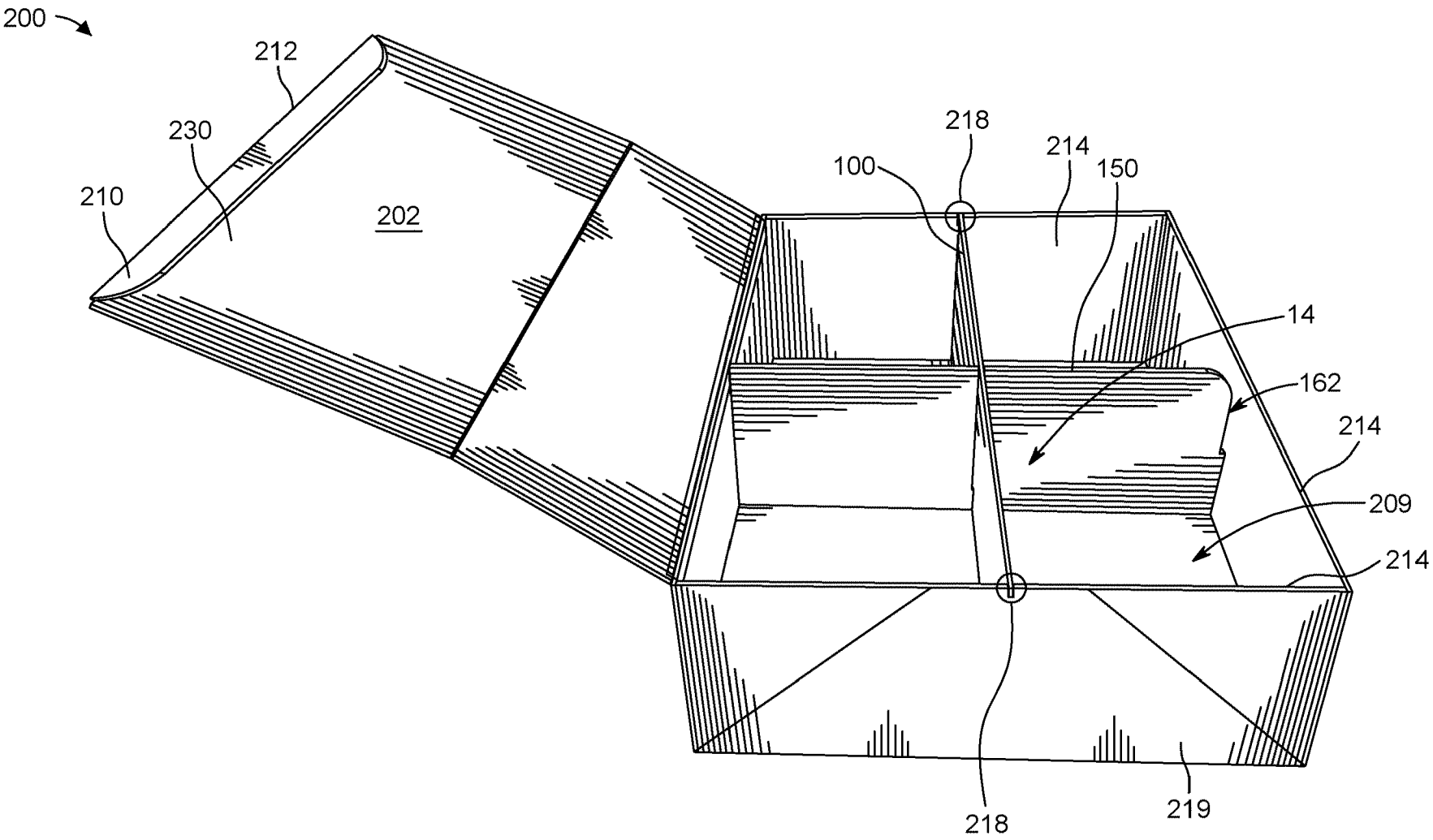
FIG. 14 is an isometric view of the food container with the spacer panel system inserted into the body portion creating a compartment arrangement.

FIG. 14 is an isometric view of the food container 200 having a second compartment arrangement 14. As shown in FIG. 14, the second compartment arrangement 14 includes one spacer panel 100 and one divider panel 150, and the slot 154 of the divider panel 150 is received in the slot 106 (see FIG. 12) centrally located on the spacer panel 100. Thus, the second compartment arrangement 14 can provide four compartments of equal size inside the internal cavity 209 of the food container 200 for separating and organizing food items.

Figure 15:
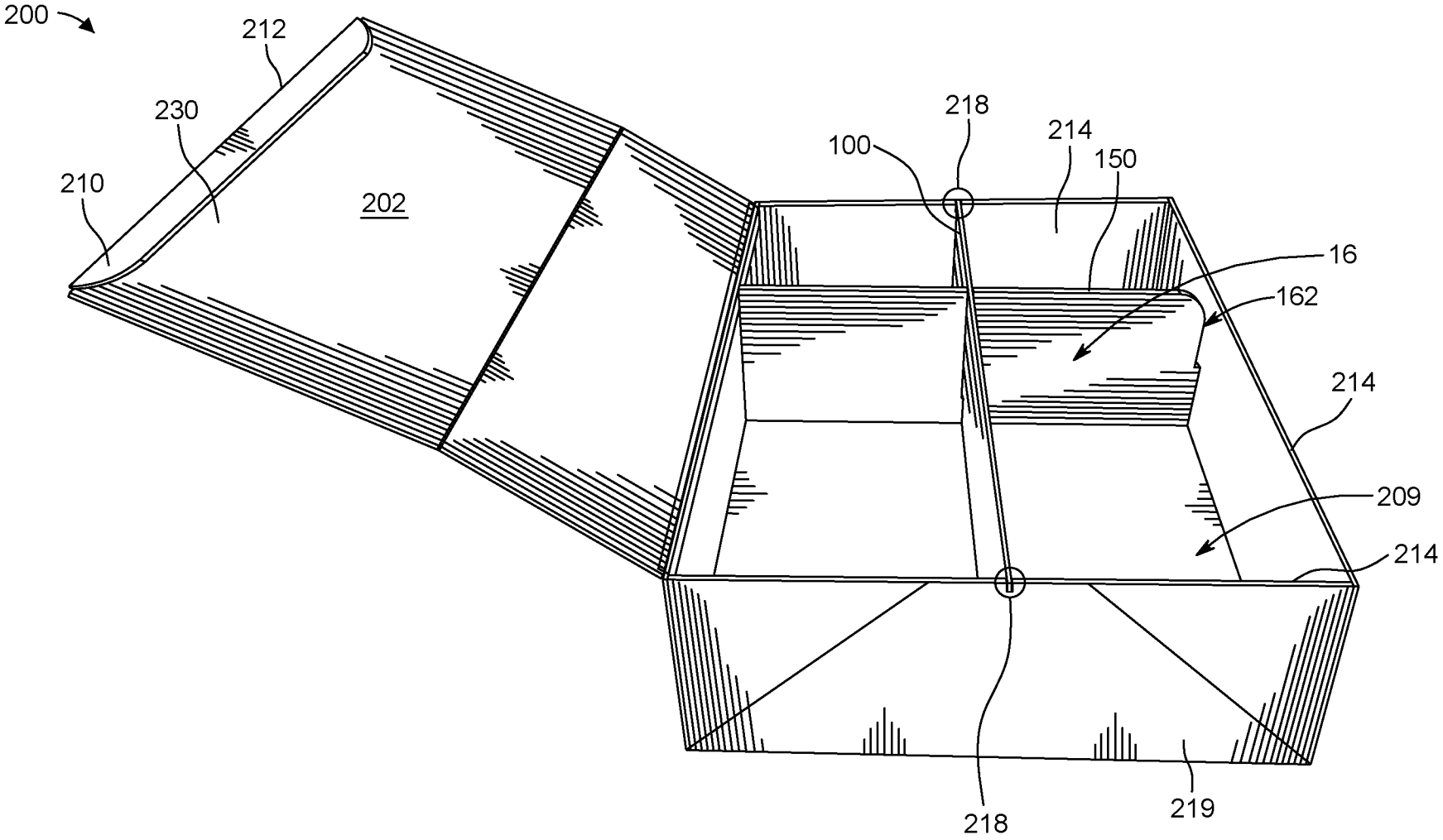
FIG. 15 is an isometric view of the food container with the spacer panel system inserted into the body portion creating another compartment arrangement.

FIG. 15 is an isometric view of the food container 200 having a third compartment arrangement 16. The third compartment arrangement 16 includes one spacer panel 100 and one divider panel 150, and the slot 154 of the divider panel 150 is received in the slot 108 (see FIG. 12) located on the right side the spacer panel 100. Thus, the third compartment arrangement 16 can provide four compartments of unequal size (e.g., two compartments larger than the other two compartments) inside the internal cavity 209 of the food container 200.

Figure 16:
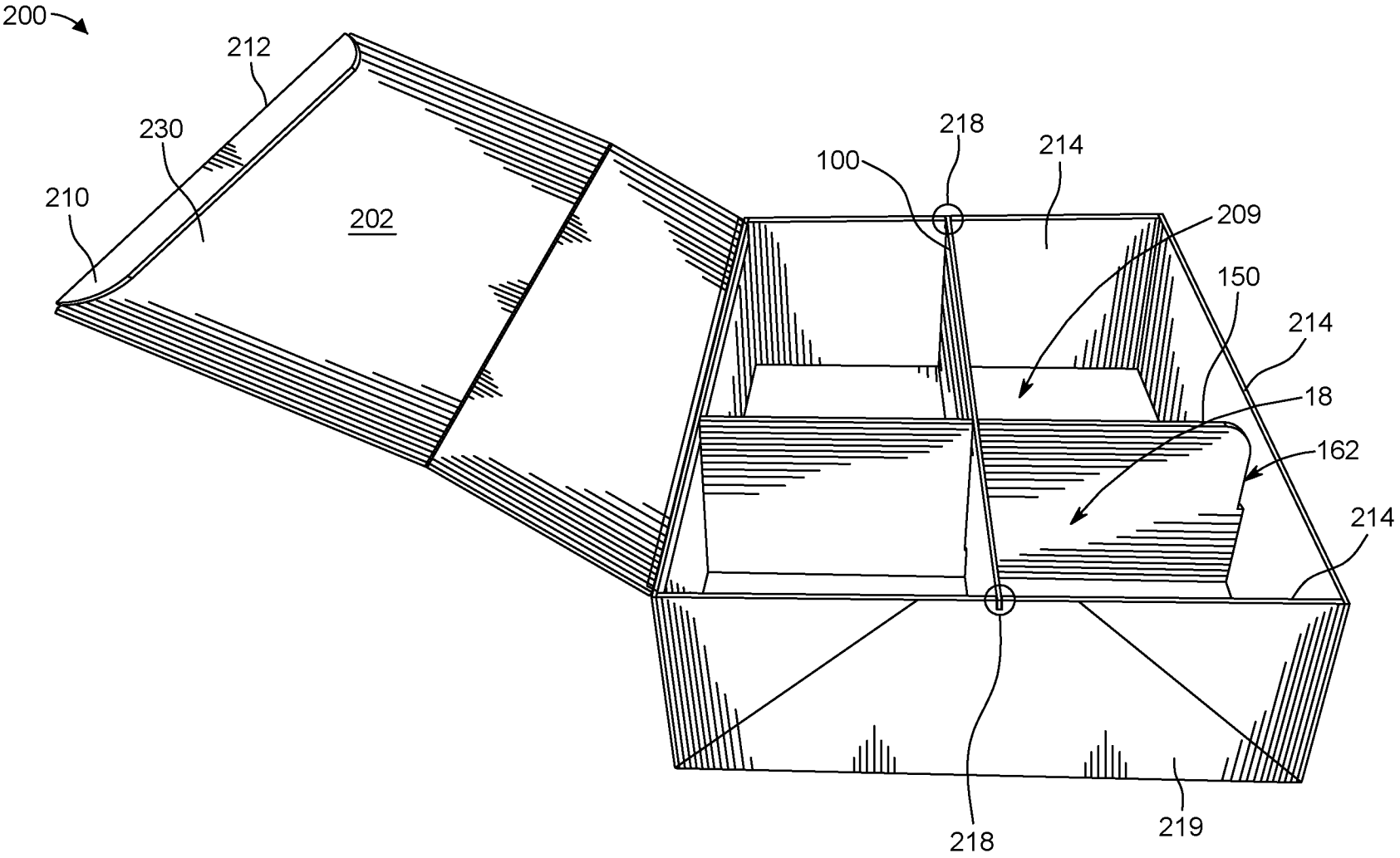
FIG. 16 is an isometric view of the food container with the spacer panel system inserted into the body portion creating another compartment arrangement.

FIG. 16 is an isometric view of the food container 200 having a fourth compartment arrangement 18. The fourth compartment arrangement 18 includes one spacer panel 100 and one divider panel 150, and the slot 154 of the divider panel 150 is received in the slot 104 (see FIG. 12) located on the left side the spacer panel 100. Thus, the fourth compartment arrangement 18 can provide four compartments of unequal size (e.g., two compartments larger than the other two compartments) inside the internal cavity 209 of the food container 200.

Referring back to FIG. 12, each divider panel 150 further includes a groove 156 on at least one end of the body 152. In the example shown, the groove 156 has a rounded edge 158 that terminates at a perpendicular ridge 160. Each groove 156 has a second depth D2 defined between the rounded edge 158 and the perpendicular ridge 160. The first depth D1 of the lip 210 of the lid 202 (see FIG. 1) is less than or equal to the second depth D2 of each groove 156.

The groove 156 of each divider panel 150 provides a recess 162 between each divider panel 150 and a sidewall 214 of the food container 200 when the spacer panel system 10 is installed inside the internal cavity 209 of the food container 200. For example, FIGS. 1 and 14-16 show recesses 162 proximate to a sidewall 214 of the food container 200.

The recess 162 receives the lip 210 of the lid 202 when the spacer panel system 10 is inside the internal cavity 209 of the body portion 201 and when the food container 200 is in the closed configuration (see FIG. 10). For example, as shown in FIG. 1, the lip 210 can be received by a recess 162 between a sidewall 214 and a divider panel 150. Thus, the groove 156 on each divider panel 150 can eliminate interference with the lid 202 by the first surface 157 of the divider panel 150 when the food container 200 is in the closed configuration.

Figure 17:
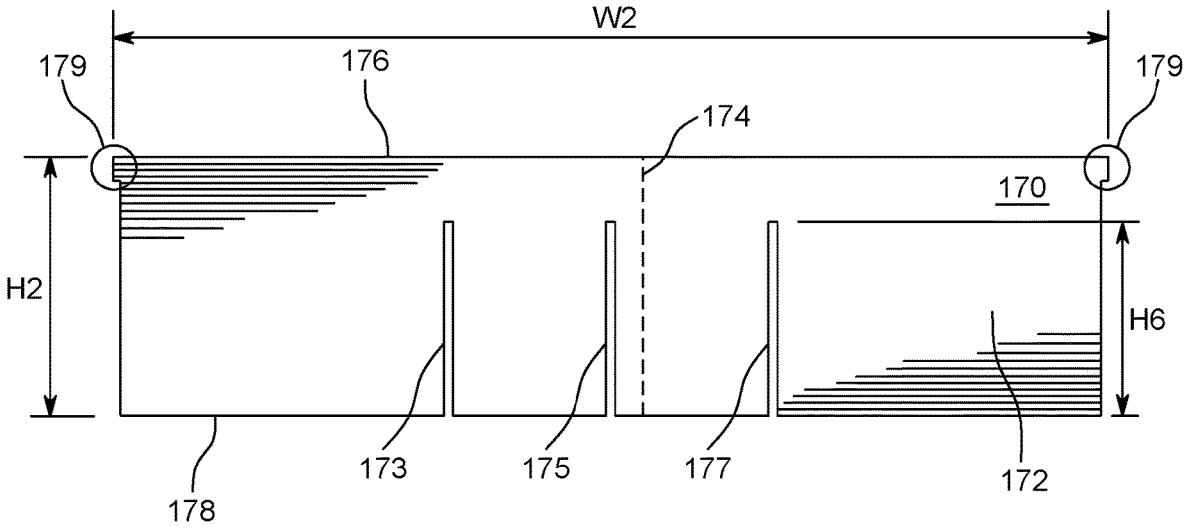
FIG. 17 is a front view of a spacer panel.

FIG. 17 is a front view of an alternative spacer panel 170. As shown in FIG. 17, the spacer panel 170 can have at least one perforation line 174 that extends between a first surface 176 and a second surface 178 of the body 172 of the spacer panel 170. The at least one perforation line 174 can be adjacent to the slots 173, 175, and 177, and can be substantially parallel to the slots. In some examples, the at least one perforation line 174 can be between adjacent slots (e.g., slots 175 and 177). The at least one perforation line 174 can be cut or torn to adjust the length of the spacer panel 170. In some examples, the spacer panel 170 can have more than one perforation line 174 such as two, three or more perforation lines 174 that extend between the first surface 176 and the second surface 178 of the spacer panel 170.

Figure 18:
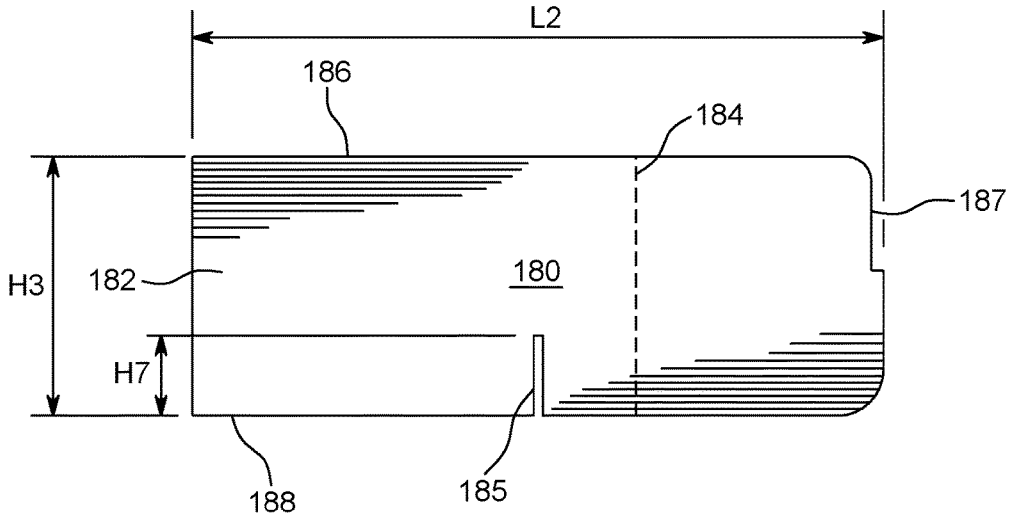
FIG. 18 is a front view of a divider panel.

FIG. 18 is a front view of an alternative divider panel 180. As shown in FIG. 18, the divider panel 180 can also include a perforation line 184 disposed between a first surface 186 and a second surface 188 of the body 182 of the divider panel 180. The perforation line 184 can be adjacent and substantially parallel to the slot 185. The perforation line 184 can be cut or torn to adjust the length of each divider panel 180. In some examples, the divider panel 180 can have more than one perforation line 184 such as two or more perforation lines 184 that extend between the first surface 186 and the second surface 188.

Figure 19:
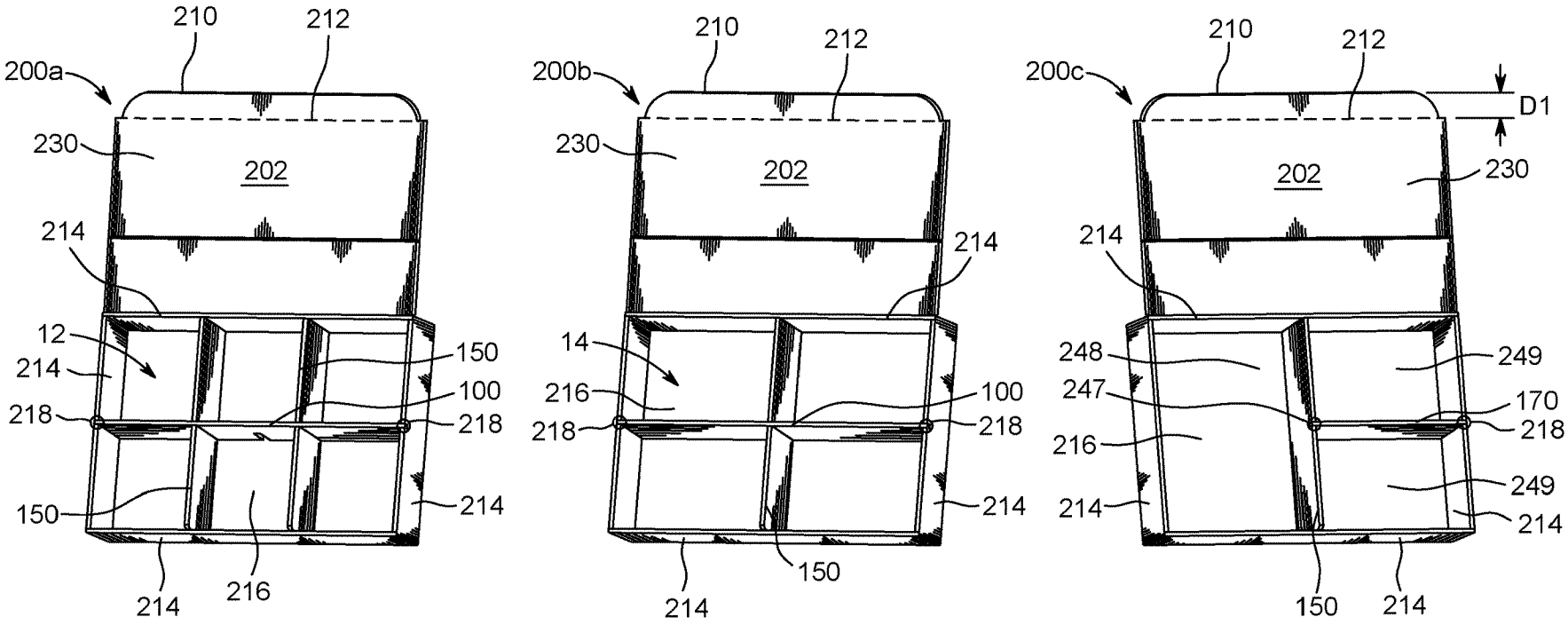
FIG. 19 is a top view of food containers, each food container having a different compartment arrangement.

FIG. 19 is a top view of several food containers each having a unique compartment arrangement. As shown in FIG. 19, a food container 200*a* includes the first compartment arrangement 12 (see also FIGS. 1 and 13) where the spacer panel system 10 includes one spacer panel 100 and two divider panels 150 that are equally spaced apart, and that in combination form six compartments of equal size inside the internal cavity of the food container 200*a*.

As further shown in FIG. 19, a food container 200*b* includes the second compartment arrangement 14 (see also FIG. 14) where the spacer panel system 10 includes one spacer panel 100 and one divider panel 150 that in combination form four compartments 222 of equal size inside the internal cavity of the food container 200*b*.

As shown in FIG. 19, a food container 200*c* includes a fifth compartment arrangement 20. The fifth compartment arrangement includes one spacer panel 170 and one divider panel 150, and where the perforation line 174 on the spacer panel 170 is cut such that the spacer panel 170 and the divider panel 150 in combination form three compartments 220 of unequal size inside the internal cavity of the food container 200*c*. For example, a first compartment 248 is about twice the size of secondary compartments 249 such that the secondary compartments 249 are equal size, and the first compartment 248 is a double size.

As also shown, an intersection 247 between the at least one divider panel 150 and the spacer panel 170 can temporarily attach the at least one divider panel 150 to the spacer panel 170 due to friction at the intersection 247 between the spacer panel 170 and the divider panel 150. As further shown, a tab 179 (see FIG. 17) on the spacer panel 170 is inserted into a notch 218 on a sidewall 214 to anchor and secure the spacer panel 170 inside the food container 200*c*.

Referring back to FIG. 12, each slot 104, 106, 108 on the spacer panel 100 has a height H4 that is less than half of a total height H2 of the spacer panel 100. In alternative examples, such as the spacer panel 170 shown in FIG. 17, each slot 173, 175, 177 of the spacer panel 170 has a height H6 that is more than half of the total height H2 of the spacer panel.

As shown in FIGS. 12 and 17, the spacer panel 100 and the spacer panel 170 each have a total width W2. The total width W2 can be substantially similar to the width W1 of the food container 200 such that the spacer panel 100 and spacer panel 170 can fit parallel to the width W1 inside the internal cavity 209 of the food container 200, while the tabs 112 and 179 of the spacer panel 100 and spacer panel 170, respectively, can be inserted into the notches 218 on the second pair of opposing sidewalls 217.

Referring back to FIG. 12, the slot 154 of the divider panel 150 has a height H5 that is more than half of the total height H3 of the divider panel 150. In alternative examples, such as the divider panel 180 shown in FIG. 18, the slot 185 of the divider panel 180 has a height H7 that is less than half of the total height H3 of the divider panel 180.

As shown in FIGS. 12 and 18, the divider panel 150 and divider panel 180 each have a total length L2. The total length L2 can be substantially similar to the length L1 of the food container 200 such that the divider panel 150 and divider panel 180 can fit parallel to the length L1 inside the internal cavity 209 of the food container 200, while the grooves 156 and 187 of the divider panel 150 and divider panel 180, respectively, provide recesses to accommodate the lid 202 when the food container 200 is in the closed configuration (see FIG. 10).

Figure 20:
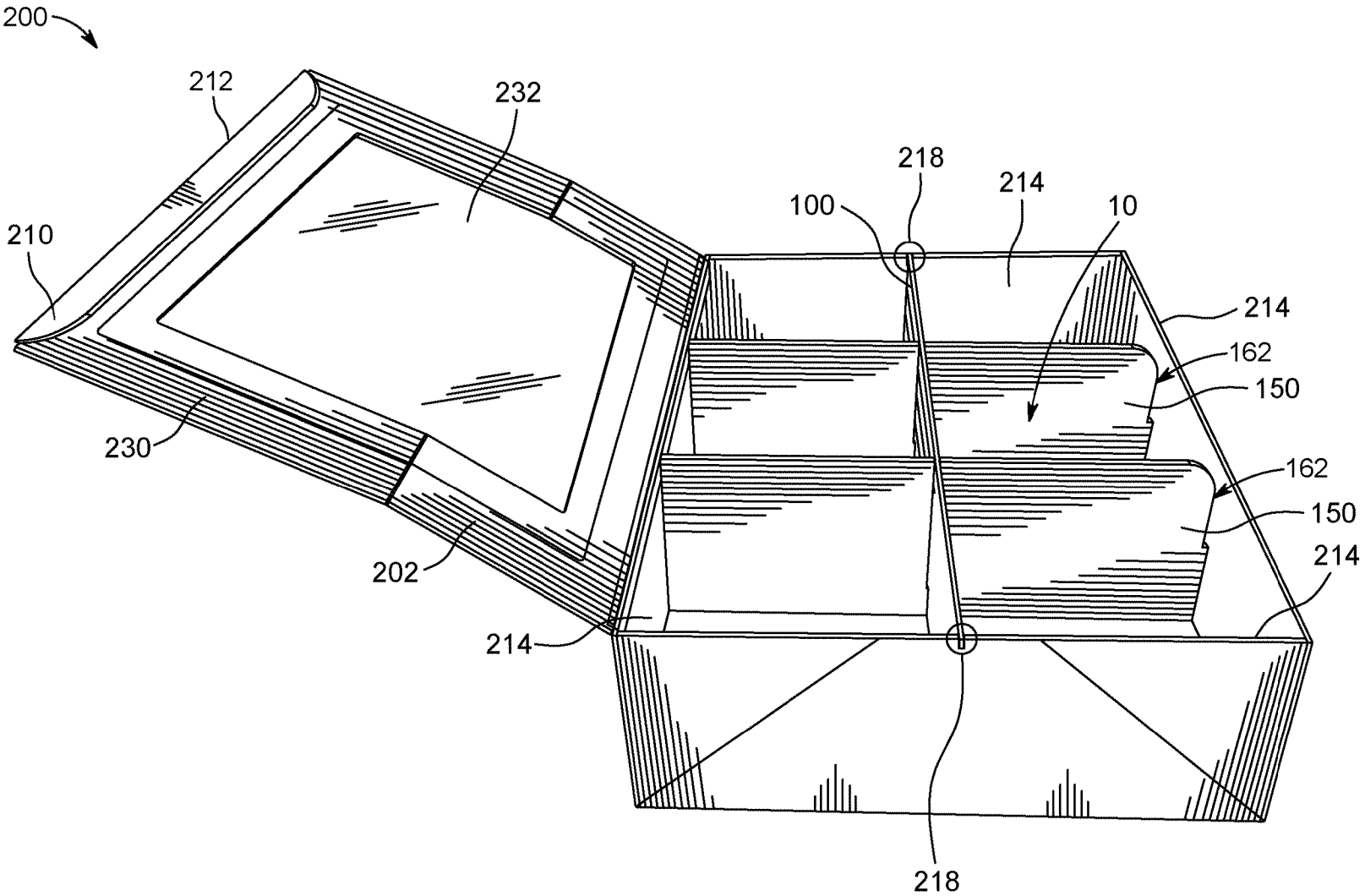
FIG. 20 is an isometric view of the food container having a window on the lid.

FIG. 20 is an isometric view of another example of the food container 200 in an open configuration. As shown in the FIG. 20, the food container 200 includes a window 232 on at least a portion of the lid 202. For example, the window 232 can cover substantially the surface area of the cover portion 230. The window 232 can be made from a transparent material such as transparent plastic film. The window 232 is advantageous because the window 232 provides the ability to see inside the internal cavity 209 of the food container 200 when the food container 200 is in the closed configuration (see FIG. 10).

Figure 21:
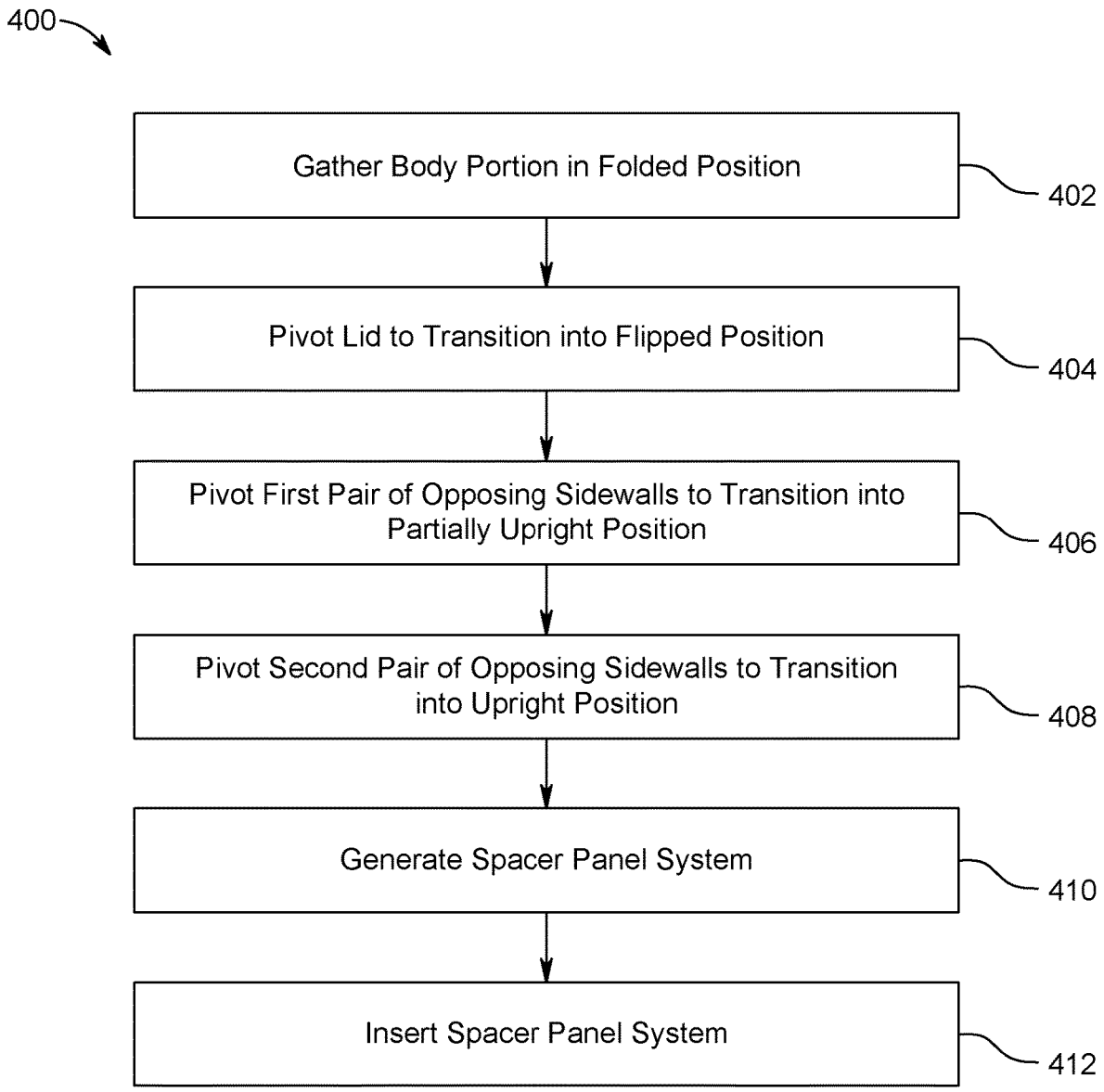
FIG. 21 illustrates a method of assembling the food container of FIG. 1.

FIG. 21 illustrates a method 400 of assembling the food container 200 depicted in FIGS. 1-20. The method 400 includes an initial step 402 of gathering the body portion 201 in a folded position (see FIG. 2). As described above, the body portion 201 is stackable in the folded position such that a large quantity of food containers can be stored within a confined space by stacking the body portion 201 when in the folded position.

Next, the method 400 includes a step 404 of pivoting the lid 202 about the first hinge 213 to transition the body portion 201 from the folded position into the flipped position (see FIG. 3). In some examples, step 404 includes pivoting the lid 202 with respect to a sidewall 214 of the body portion 201 and exposing the bottom panel 216.

Thereafter, the method 400 includes a step 406 of pivoting the first pair of opposing sidewalls 215 from the horizontal position to the vertical position to transition the body portion 201 from the flipped position into the partially upright position (see FIG. 4).

Next, the method 400 includes a step 408 of pivoting the second pair of opposing sidewalls 217 from the horizontal position to the vertical position to transition the body portion 201 from the partially upright position to the upright position (see FIG. 5).

In some examples, steps 406 and 408 include using the foils 219 to guide the transition of the body portion 201 from the flipped position (see FIG. 3) to the upright position (see FIG. 5) by guiding the first pair of opposing sidewalls 215 with respect to the bottom panel 216, and guiding the second pair of opposing sidewalls 217 with respect to the bottom panel 216 for arranging the sidewalls 214 in the vertical position around the bottom panel 216. Thereafter, the foils 219 can also operate to lock the second pair of opposing sidewalls 217 in position, which in conjunction with adjacent support from the first pair of opposing sidewalls 215, prevent the second pair of opposing sidewalls 217 from moving more than 90 degrees past the hinges 231 to help maintain the body portion 201 in the upright position.

Next, the method 400 includes a step 410 of generating the spacer panel system 10 by coupling the slot 154 of at least one divider panel 150 to at least one slot 104, 106, 108 of the spacer panel 100. In some examples, only one divider panel 150 is coupled to one spacer panel 100. In other examples, two or more divider panels 150 are coupled to one spacer panel 100.

The method 400 next includes a step 412 of inserting the spacer panel system 10 into the body portion 201. In some examples, step 412 includes slotting the tabs 112 of the spacer panel 100 into the notches 218 on the opposing sidewalls of the body portion 201.

In examples where only one divider panel 150 is coupled to one spacer panel 100, the method 400 can include forming a compartment arrangement having four compartments of equal size (see FIG. 14). In other alternative examples where only one divider panel 150 is coupled to one spacer panel 100, the method 400 can include forming a compartment arrangement having four compartments of unequal size (see FIGS. 15 and 16). In other alternative examples where two divider panels 150 are coupled to one spacer panel 100, the method 400 can include forming a compartment arrangement having six compartments of equal size (see FIG. 1).

In some examples, the method 400 includes an additional step of cutting or tearing a spacer panel 170 along a perforation line 174 to adjust the length of the spacer panel 170. Thereafter, the method 400 includes inserting the spacer panel system 10 into the body portion 201 by slotting a tab 179 of the spacer panel 170 into the notches 218 on the opposing sidewalls of the body portion 201 to form a compartment arrangement having an odd number of compartments of unequal size (see food container 200*c* in FIG. 19).

In alternative examples, the method 400 includes first inserting one or more divider panels 150 into the internal cavity 209, and thereafter inserting the spacer panel 100 into the internal cavity 209 such that the slots 104, 106, 108 of the spacer panel 100 are received by a slot 154 of each divider panel 150 and the tabs 112 of the spacer panel 100 are received in the notches 218 on the opposing sidewalls of the body portion 201.

Figure 22:
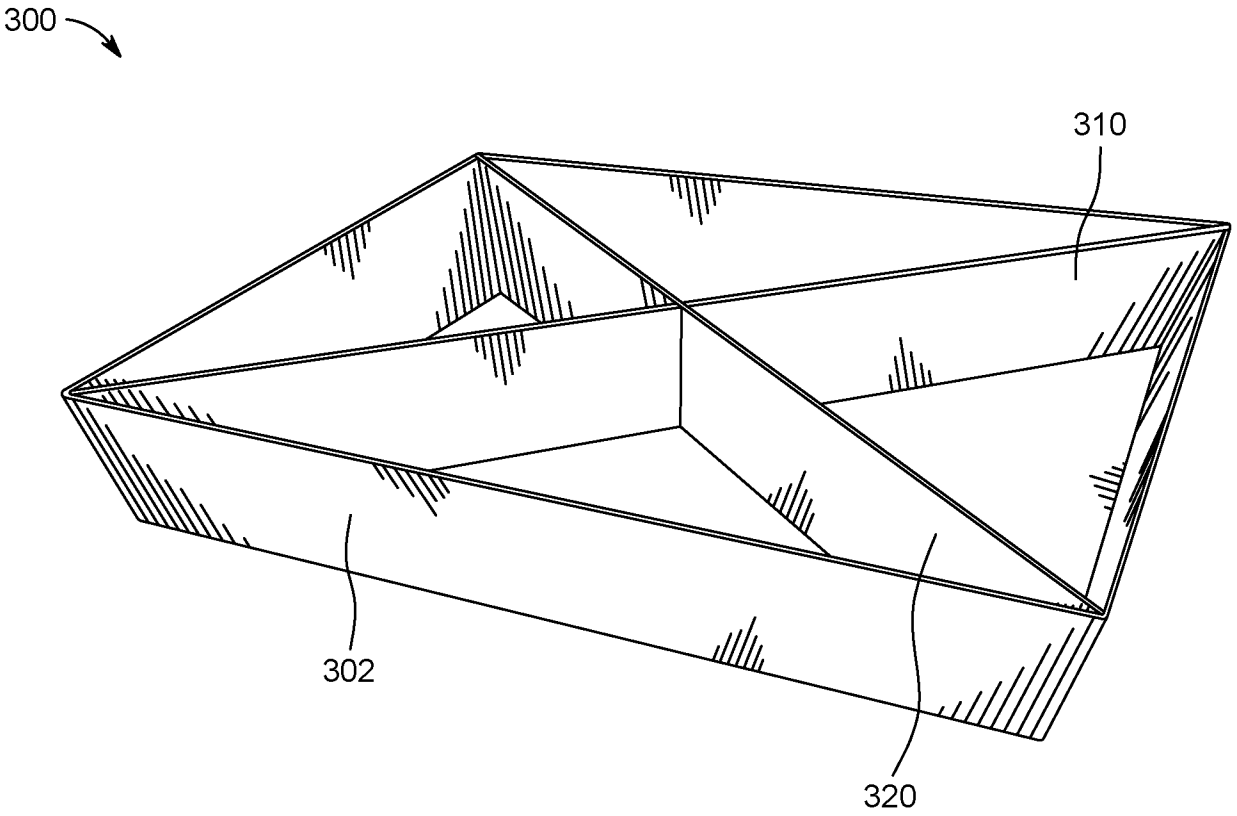
FIG. 22 is an isometric view of another example of a food container.
Figure 23:
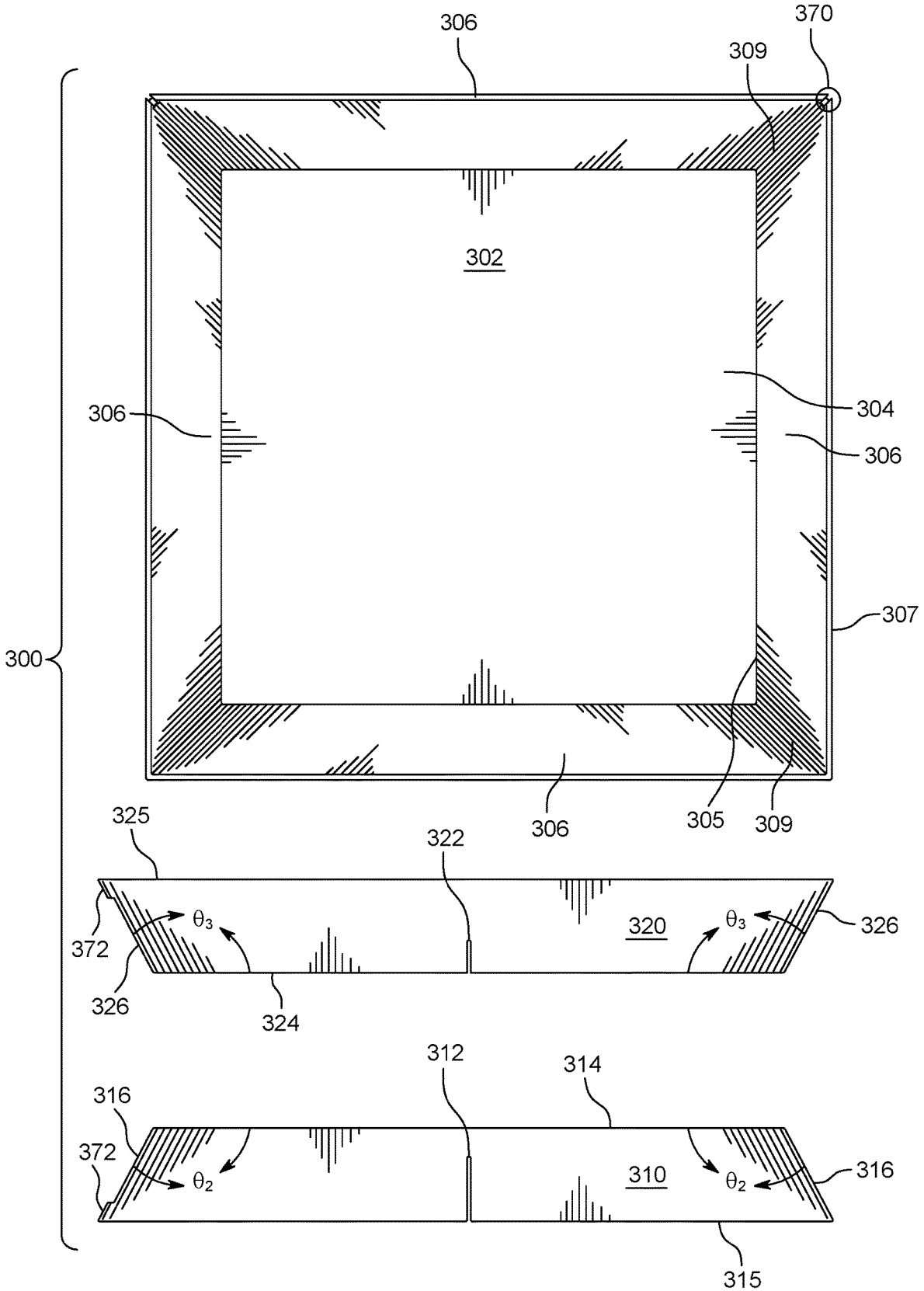
FIG. 23 is a top view of the food container of FIG. 22 in a disassembled state.

FIG. 22 is an isometric view of a food container 300 in accordance with another example of the present disclosure. FIG. 23 is a top view of the food container 300 in a disassembled state. As shown in FIGS. 22 and 23, the food container 300 includes a body 302, a first diagonal panel 310, and a second diagonal panel 320.

Figure 24:
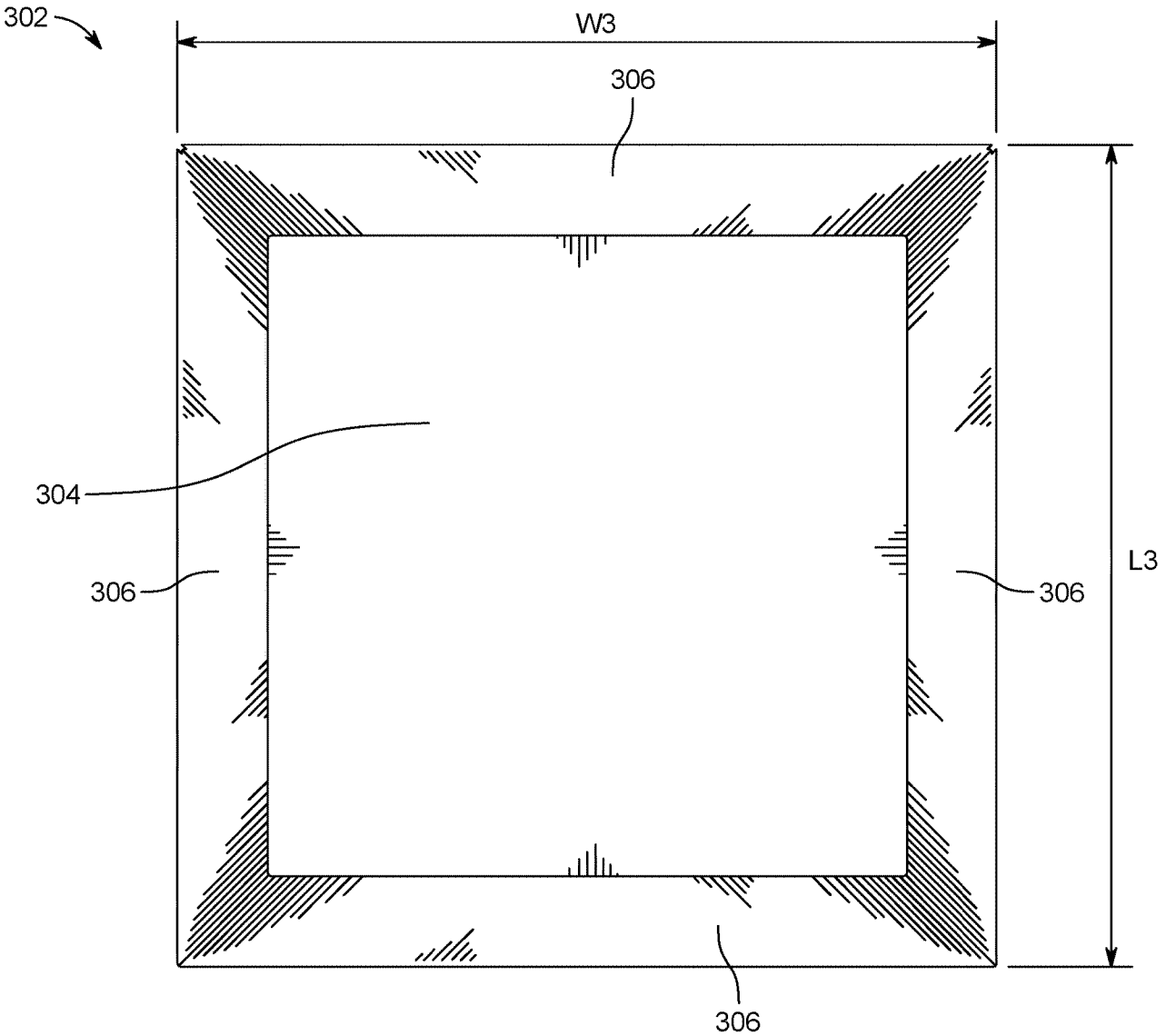
FIG. 24 is a bottom view of the body of the food container of FIG. 22.

FIG. 24 is a bottom view of the body 302 of the food container 300. As shown in FIG. 24, the body 302 includes a bottom panel 304 and side panels 306. In some examples, the bottom panel 304 has a substantially rectangular shape. As noted above, the term rectangular includes a square. It is contemplated that the bottom panel 304 can have alternative shapes including various quadrilateral, parallelogram, triangular, circular, oval, etc. shapes.

Figure 25:
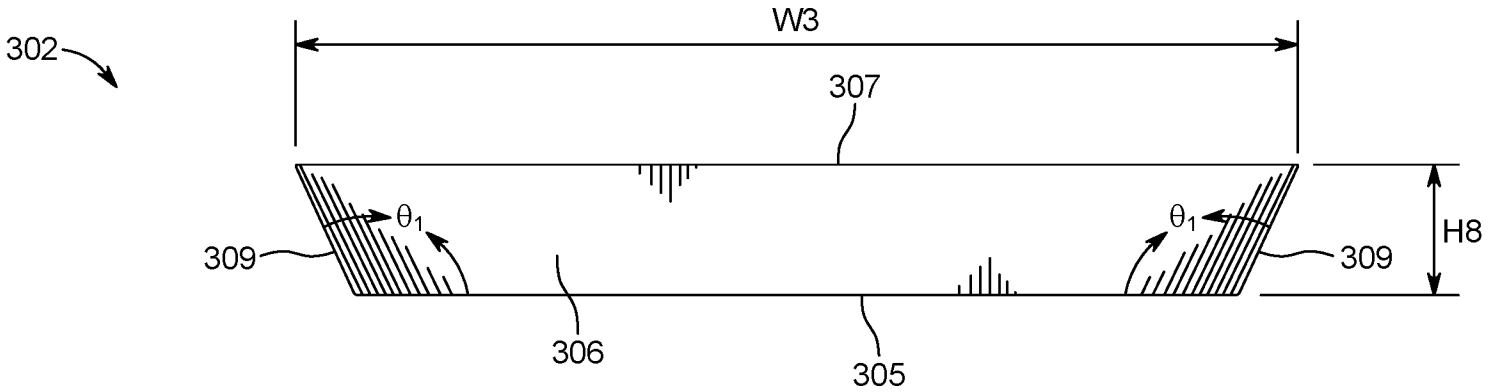
FIG. 25 is a side view of the body of the food container of FIG. 22.

FIG. 25 is a side view of the body 302 of the food container 300. The front, rear, left side, and right side views of the body 302 are substantially similar. As shown in FIG. 25, each side panel 306 includes a short parallel side 305, a long parallel side 307, and lateral sides 309. In some examples, each side panel 306 has a substantially trapezoidal shape.

As shown in FIGS. 24 and 25, the side panels 306 extend from the bottom panel 304 at an angle $\theta_1$. In some examples, the angle this an inclined angle. The angle $\theta_1$ can help stack multiple food containers 300 without compromising the structural integrity of each food container 300. In some examples, the side panels 306 extend at an angle $\theta_1$ of about 150° to about 110° from the bottom panel 304. In some examples, the side panels 306 extend at an angle θ1 about 135° to about 120° from the bottom panel 304.

As also shown in FIGS. 24 and 25, the body 302 of the food container 300 has a width W3 and a length L3. Additionally, the food container 300 has a height H8. In some examples, the width W3 can range from about 5 inches to about 24 inches. In some examples, the length L3 can range from about 5 inches to about 24 inches. In some examples, the height H8 can range from about 1 inches to about 8 inches. In some examples, the length L3×width W3×height H8 the body 302 of the food container 300 is about 12×12×4 inches.

Referring back to FIG. 23, the first diagonal panel 310 includes a first slot 312, a short parallel side 314, a long parallel side 315, and lateral sides 316. In some examples, the first diagonal panel 310 has a substantially trapezoidal shape similar to the side panels 306.

The lateral sides 316 are angled with respect to the short parallel side 314 and the long parallel side 315. For example, the lateral sides 316 have an angle $\theta_2$ of about 150° to about 110° with respect to the short parallel side 314. In certain examples, the lateral sides 316 have an angle $\theta_2$ of about 135° to about 120° with respect to the short parallel side 314.

Figure 26:
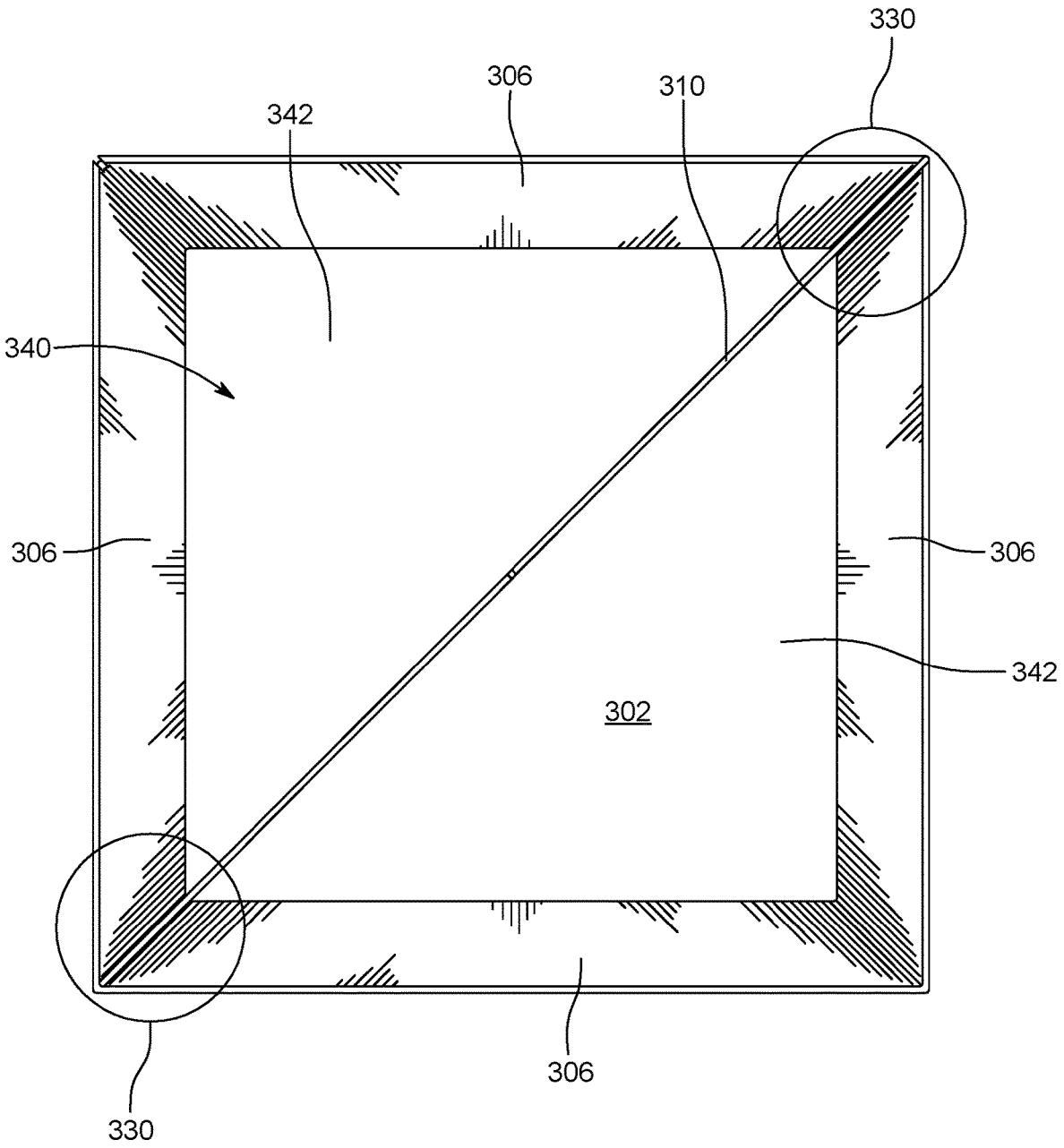
FIG. 26 is a top view of the food container of FIG. 22 in a partially assembled state.
Figure 27:
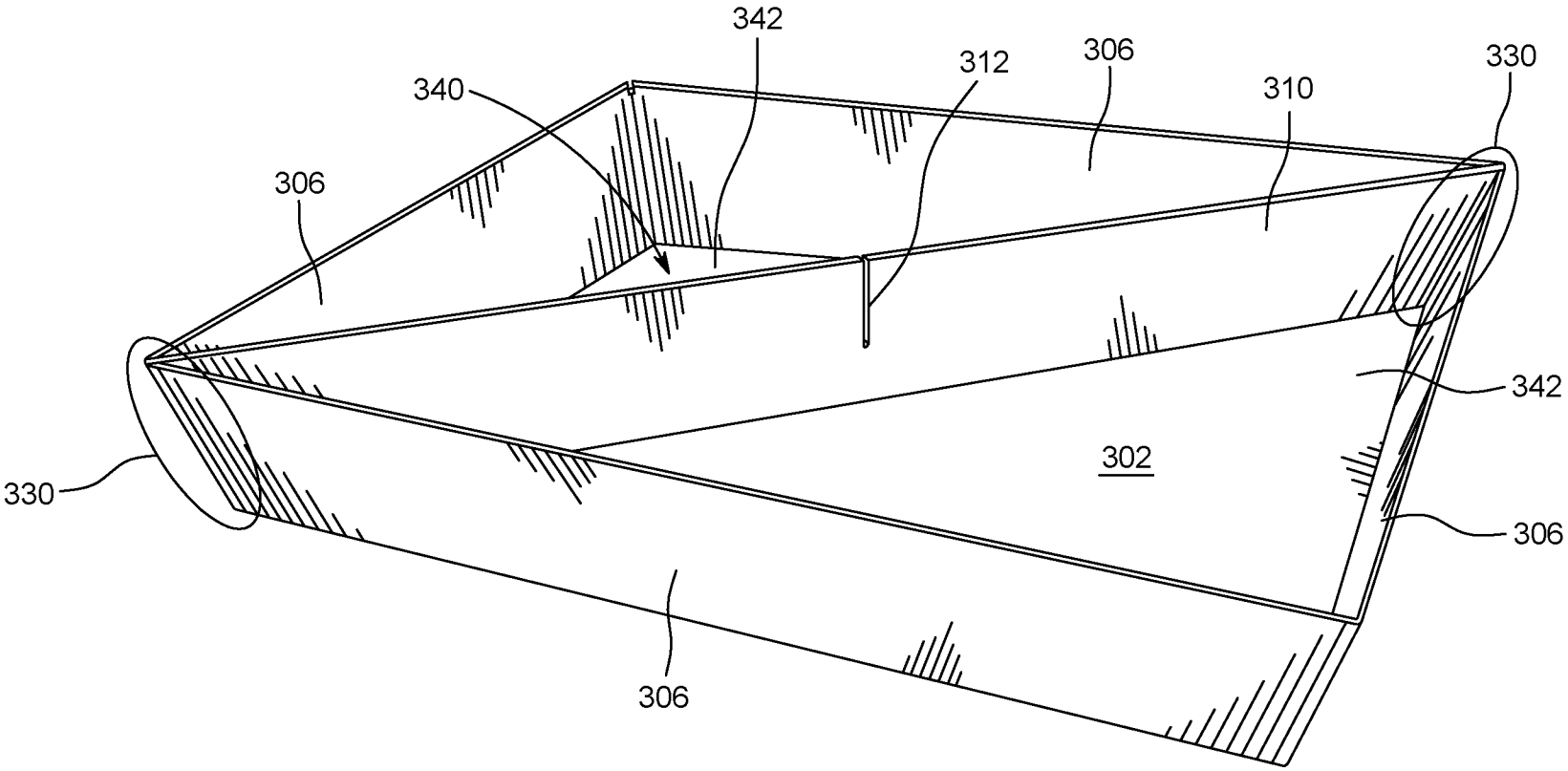
FIG. 27 is an isometric view of the food container in a partially assembled state.

FIG. 26 is a top view of the food container 300 in a partially assembled state. FIG. 27 is an isometric view of the food container 300 in the partially assembled state. As shown in FIGS. 26 and 27, the lateral sides 316 of the first diagonal panel 310 are accommodated in a first pair of opposing corners 330 in the body 302. Each opposing corner 330 is between side panels 306 of the body 302. As shown in FIGS. 26 and 27, the first diagonal panel 310 creates a first compartment arrangement 340. In the first compartment arrangement 340, the first diagonal panel 310 provides two compartments 342 of equal size in the food container 300.

Referring back to FIG. 23, the second diagonal panel 320 includes a second slot 322, a short parallel side 324, a long parallel side 325, and lateral sides 326. In some examples, the second diagonal panel 320 has a substantially trapezoidal shape similar to the side panels 306.

The lateral sides 326 are angled with respect to the short parallel side 324 and the long parallel side 325. For example, the lateral sides 326 have an angle $\theta_3$ of about 150° to about 110° with respect to the short parallel side 324. In certain examples, the lateral sides 326 have an angle $\theta_3$ of about 135° to about 120° with respect to the short parallel side 324.

Figure 28:
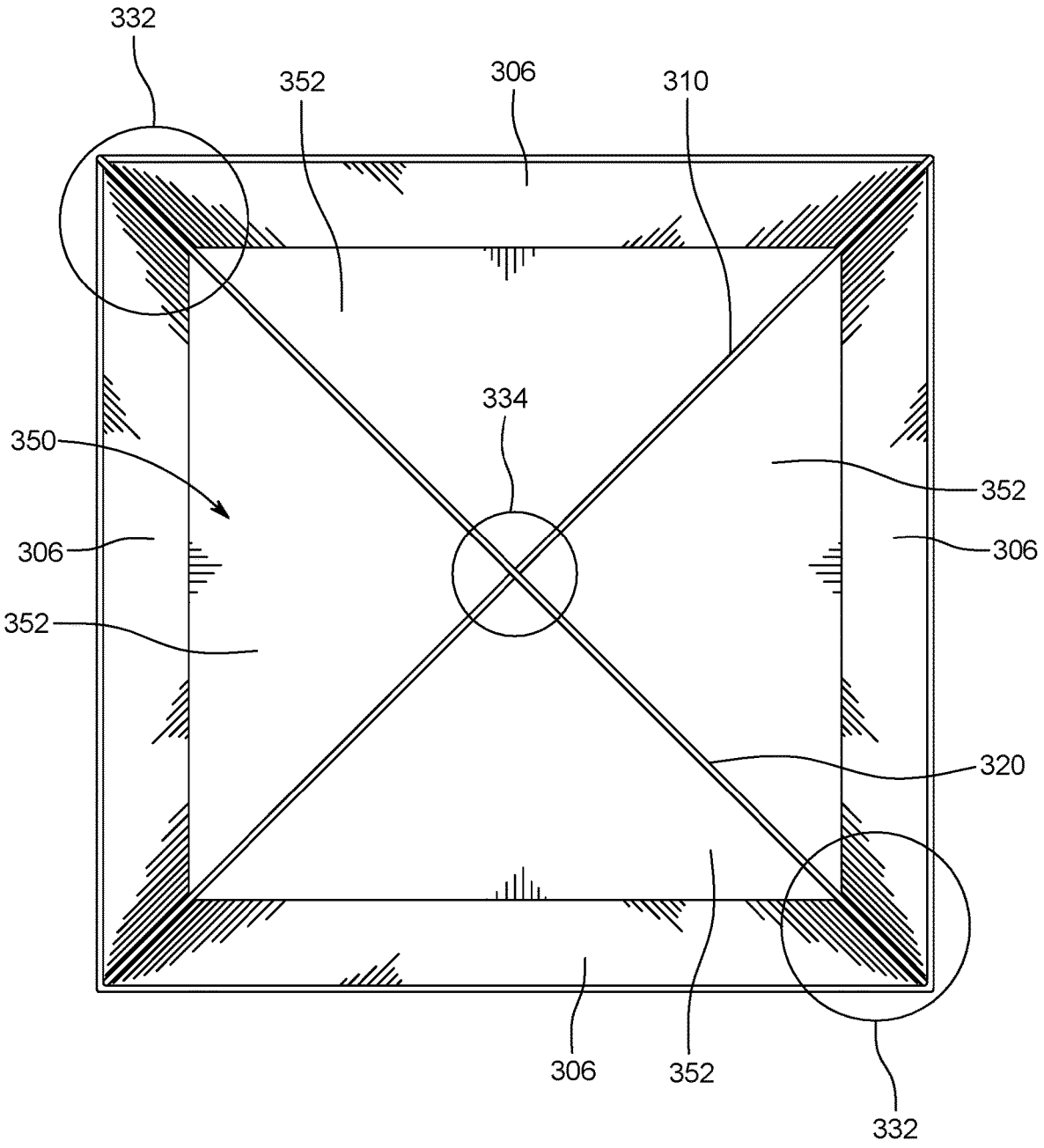
FIG. 28 is a top view of the food container of FIG. 22 in an assembled state.
Figure 29:
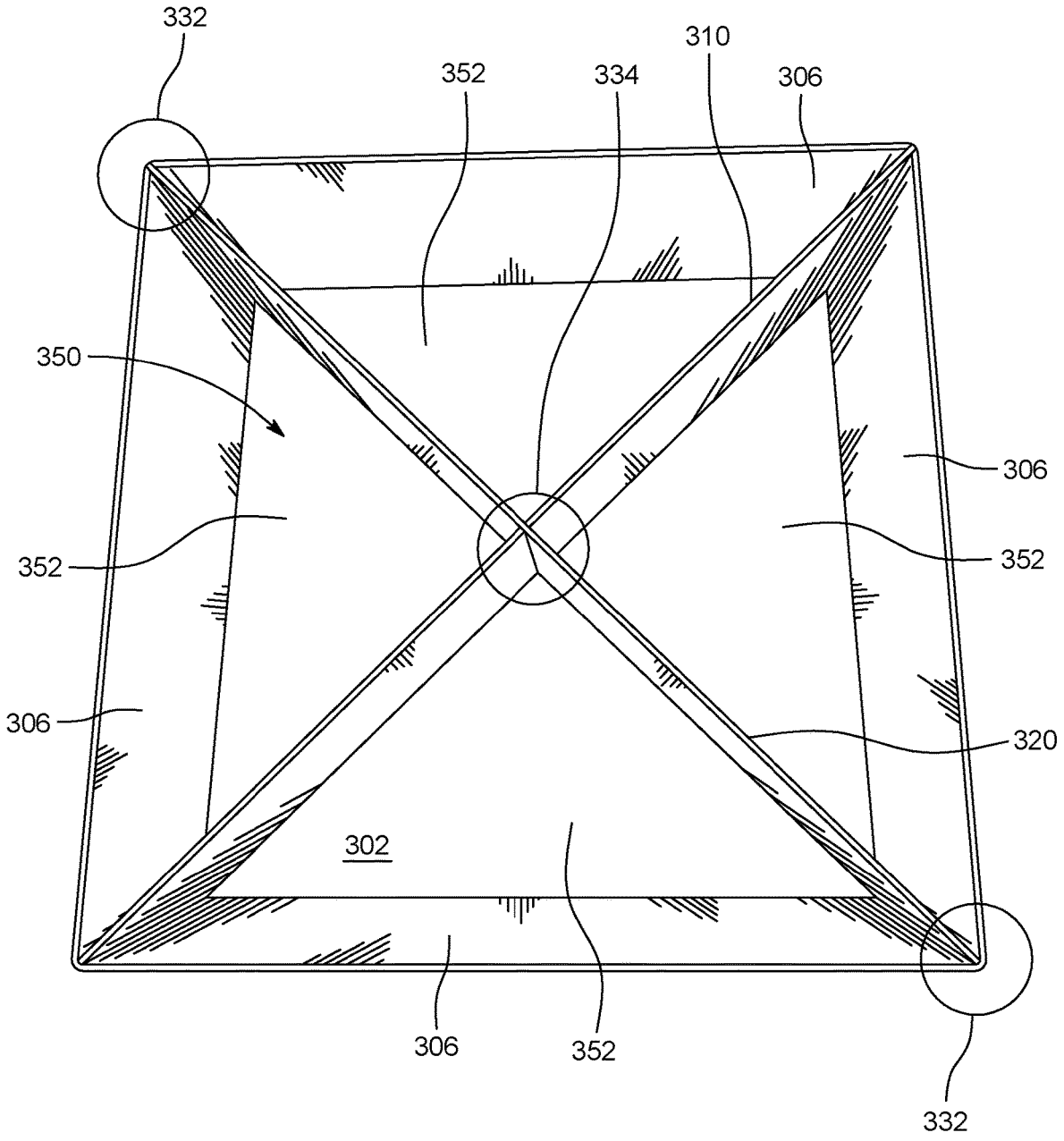
FIG. 29 is an isometric view of the food container of FIG. 22 in an assembled state.

FIG. 28 is a top view of the food container 300 in an assembled state. FIG. 29 is an isometric view of the food container 300 in the assembled state. As shown in FIGS. 28 and 29, the second slot 322 of the second diagonal panel 320 is fixed to the first slot 312 of the first diagonal panel 310. An intersection 334 between the first diagonal panel 310 and the second diagonal panel 320 is substantially orthogonal. The intersection 334 can temporarily attach the first diagonal panel 310 and the second diagonal panel 320 due to friction at the intersection 334 between the first diagonal panel 310 and the second diagonal panel 320.

As shown in FIGS. 28 and 29, each lateral side 326 of the second diagonal panel 320 is accommodated in a second pair of opposing corners 332 in the body 302. Each opposing corner 332 is between side panels 306. As shown in FIGS. 28 and 29, the first diagonal panel 310 and the second diagonal panel 320 create a second compartment arrangement 350 in the food container 300. The second compartment arrangement 350 can have a substantially X shape having four compartments 342 of equal size.

The first diagonal panel 310 and the second diagonal panel 320 when inserted into the body 302 of the food container 300, to generate the first compartment arrangement 340 or the second compartment arrangement 350, can help mitigate or prevent uneven dispersions of food mass held by the food container 300.

Referring back to FIG. 23, in some examples the body 302 of the food container 300 includes at least one notch 370 in a corner between two side panels 306. The at least one notch 370 can receive a tab 372 from at least one of the first diagonal panel 310 and the second diagonal panel 320 to help secure the first diagonal panel 310 and the second diagonal panel 320 to the body 302, and to also improve the structural rigidity of the body 302.

The body 302 (including the bottom panel 304 and side panels 306), the first diagonal panel 310, and the second diagonal panel 320 are made from a sustainable and eco-friendly material that is structural durable so that the food container 300 does not buckle or deform from the weight of food, and is oil and water resistant. In preferred examples, the body 302, the first diagonal panel 310, and the second diagonal panel 320 are made from a re-usable wood material. In some examples, the re-usable wood material is a wax coated balsa wood. In other alternative examples, the body 302, the first diagonal panel 310, and the second diagonal panel 320 are made from die cut pieces of corrugated cardboard, paper board, or fiber board.

Figure 30:
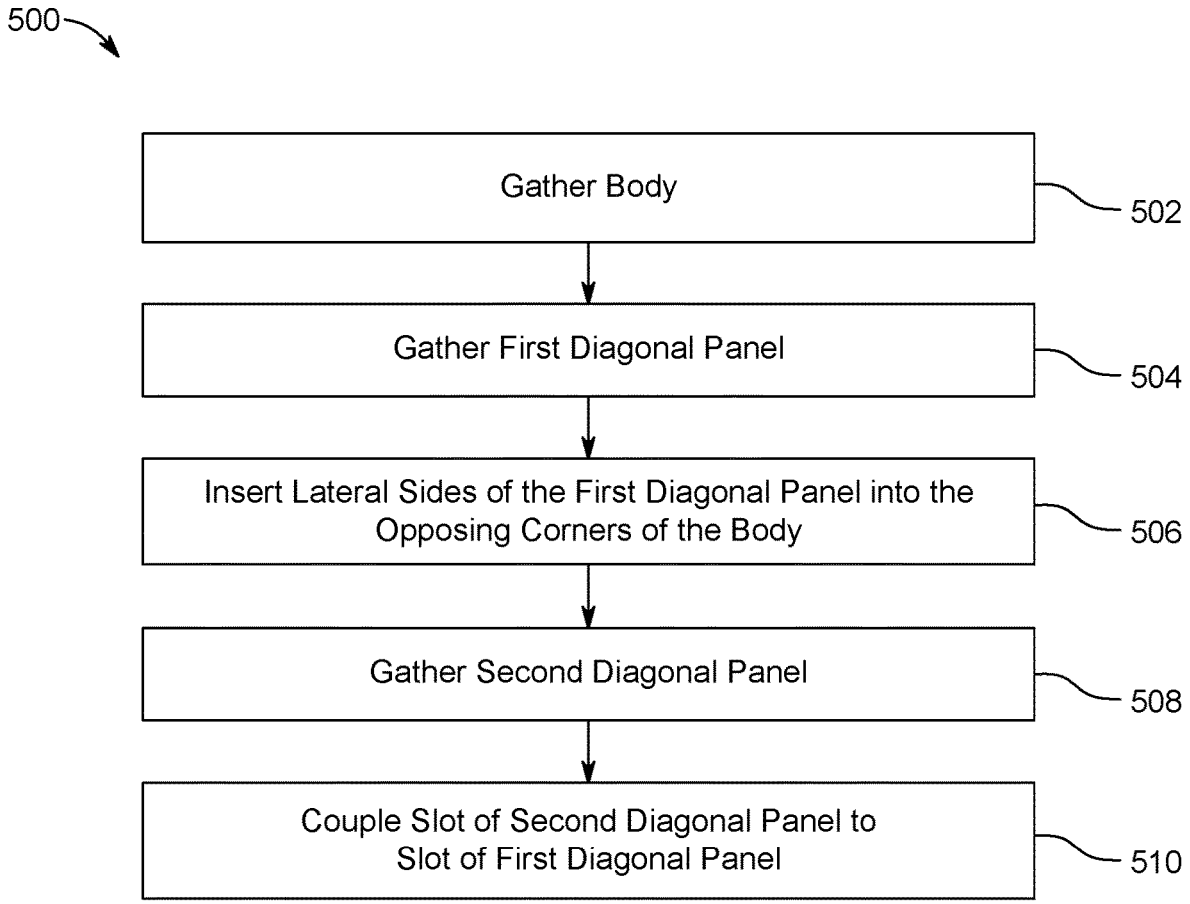
FIG. 30 illustrates a method of assembling the food container of FIG. 22.

FIG. 30 is a diagram illustrating a method 500 of assembling the food container 300 depicted in FIGS. 22-29. The method 500 includes a step 502 of gathering the body 302 that includes the bottom panel 304 and a plurality of side panels 306.

The method 500 next includes a step 504 of gathering the first diagonal panel 310. The first diagonal panel 310 includes the first slot 312 and lateral sides 316 that are angled with respect to the short parallel side 314 and the long parallel side 315.

Next, the method 500 includes a step 506 of inserting the lateral sides 316 of the first diagonal panel 310 into the opposing corners 330 of the body 302. In this manner, the method 500 forms the first compartment arrangement 340 (see FIGS. 26 and 27) having two compartments 352 of equal size. In some examples, step 506 includes inserting a tab 372 of the first diagonal panel 310 into a notch 370 between a pair of side panels 306 of the body 302 for securing the first diagonal panel 310 to the body 302 of the food container 300.

Thereafter, the method 500 includes a step 508 of gathering a second diagonal panel 320. The second diagonal panel 320 includes the second slot 322 and lateral sides 316 that are angled with respect to the short parallel side 324 and the long parallel side 325.

Next, the method 500 includes a step 510 of coupling the second slot 322 of the second diagonal panel 320 to the first slot 312 of the first diagonal panel 310, and inserting the lateral sides 326 of the second diagonal panel 320 to opposing corners 332 in the body 302. In this manner, the method 500 forms the second compartment arrangement 350 (see FIGS. 28 and 29) having four compartments 352 of equal size. In some examples, step 510 includes inserting a tab 372 of the second diagonal panel 320 into a notch 370 between a pair of side panels 306 of the body 302 for securing the second diagonal panel 320 to the body 302.

The various embodiments described above are provided by way of illustration only and should not be construed to limit the claims attached hereto. Those skilled in the art will readily recognize various modifications and changes that may be made without following the example embodiments and application illustrated and described herein, and without departing from the true spirit and scope of the following claims.

What is claimed is:

1. A food container comprising:

a body portion including:

a bottom panel;

a plurality of sidewalls, each sidewall pivotally connected to the bottom panel, at least one sidewall having a notch on a top portion;

a lid pivotally connected to at least one sidewall, the lid having a lip; and a spacer panel system inserted into the body portion, the spacer panel system including:

a spacer panel having a body with one or more slots, the body having top and bottom edges and opposing side edges, and having at least one tab extending from the top edge for insertion into the notch on the top portion of the at least one sidewall to anchor the spacer panel system to the body portion; and at least one divider panel having a body with a slot and a groove located on at least one end of the body, the slot of the at least one divider panel being insertable into any one of the slots of the spacer panel, and the groove of the at least one divider panel providing a recess between the spacer panel system and a sidewall of the body portion.

2. The food container of claim 1, wherein the lip has a first depth, and the groove has a second depth between a rounded edge that terminates at a perpendicular ridge, and the first depth of the lip is less than or equal to the second depth of the groove.

3. The food container of claim 1, wherein spacer panel system includes a plurality of divider panels, each divider panel having a groove providing more than one recess between the plurality of divider panels and the sidewall, each recess constructed to receive the lip of the lid.

4. The food container of claim 1, wherein an intersection between the least one divider panel and the spacer panel temporarily attaches the least one divider panel to the spacer panel.

5. The food container of claim 1, wherein the spacer panel includes at least one perforation line extending between a first surface and a second surface of the body of the spacer panel, the at least one perforation line configured to adjust the length of the spacer panel.

6. The food container of claim 1, wherein the body portion includes foils configured to guide a first pair of opposing sidewalls from a horizontal position to a vertical position.

7. The food container of claim 6, wherein the foils are made from rice paper and the opposing sidewalls are made from waxed coated balsa wood.

8. The food container of claim 1, wherein the plurality of sidewalls include a first pair of opposing sidewalls and a second pair of opposing sidewalls, both the first pair of opposing sidewalls and the second pair of opposing sidewalls are pivotally connected to the bottom panel and configured to pivot from a horizontal position to a vertical position.

9. The food container of claim 8, wherein the spacer panel system provides a compartment arrangement inside the body portion having six compartments of equal size.

10. The food container of claim 8, wherein the spacer panel system provides a compartment arrangement inside the body portion having four compartments of equal size.

11. The food container of claim 8, wherein the spacer panel system provides a compartment arrangement inside the body portion having four compartments of unequal size.

12. The food container of claim 8, wherein the spacer panel system provides a compartment arrangement inside the body portion having three compartments of unequal size.

13. The food container of claim 1, wherein the body portion is made from a wood material.

14. The food container of claim 1, wherein the body portion is made from a single die cut piece of corrugated cardboard, paper board, or fiber board.

15. The food container of claim 1, wherein the body portion includes a window on the lid.

16. The food container of claim 1, wherein the body portion has a first pair of opposing sidewalls, each opposing sidewall in the first pair of opposing sidewalls pivotally connected to the bottom panel and having a notch on a top portion; and wherein the spacer panel is orthogonal to the first pair of opposing sidewalls and includes tabs each extending from the top edge for insertion into a notch on the opposing sidewalls in the first pair of opposing sidewalls.

17. A food container comprising:

a body having a bottom panel and side panels extending from the bottom panel at an angle greater than 90 degrees, the side panels forming pairs of opposing corners, and the body having a notch in at least one corner between adjacent side panels; and a first diagonal panel having a first slot, and top, bottom, and lateral edges, each lateral edge extending from the bottom edge at an angle greater than 90 degrees and being accommodated in a first pair of opposing corners in the body, at least one lateral edge of the first diagonal panel having a tab that extends from the top edge for insertion into the notch.

18. The food container of claim 17, wherein the first diagonal panel forms a first compartment arrangement having two compartments of equal size.

19. The food container of claim 17, further comprising a second diagonal panel having a second slot, and top, bottom, and lateral edges, the second slot being received into the first slot, and the lateral edges of the second diagonal panel being received in a second pair of opposing corners.

20. The food container of claim 19, wherein the first diagonal panel and the second diagonal panel form a second compartment arrangement having four compartments of equal size.

21. The food container of claim 19, further comprising at least one notch in each pair of opposing corners, and at least one tab on each diagonal panel.

* * * * *